US009178317B2

(12) United States Patent
Holland

(10) Patent No.: US 9,178,317 B2
(45) Date of Patent: Nov. 3, 2015

(54) COAXIAL CONNECTOR WITH INGRESS REDUCTION SHIELD

(71) Applicant: Holland Electronics, LLC, Ventura, CA (US)

(72) Inventor: Michael Holland, Santa Barbara, CA (US)

(73) Assignee: Holland Electronics, LLC, Ventura, CA (US)

( * ) Notice: Subject to any disclaimer, the term of this patent is extended or adjusted under 35 U.S.C. 154(b) by 28 days.

(21) Appl. No.: 14/069,221

(22) Filed: Oct. 31, 2013

(65) Prior Publication Data

US 2014/0162494 A1 Jun. 12, 2014

Related U.S. Application Data

(63) Continuation-in-part of application No. 13/712,828, filed on Dec. 12, 2012.

(60) Provisional application No. 61/620,355, filed on Apr. 4, 2012.

(51) Int. Cl.
*H01R 13/658* (2011.01)
*H01R 24/44* (2011.01)
*H01R 13/6474* (2011.01)

(52) U.S. Cl.
CPC ..... *H01R 13/658* (2013.01); *H01R 24/44* (2013.01); *H01R 13/6474* (2013.01)

(58) Field of Classification Search
CPC ..... H01R 13/646
USPC ..... 439/63, 578, 580–585
See application file for complete search history.

(56) References Cited

U.S. PATENT DOCUMENTS

| | | | | | |
|---|---|---|---|---|---|
| 3,757,279 | A | * | 9/1973 | Winston | 439/584 |
| 4,275,946 | A | | 6/1981 | Manina et al. | |
| 4,633,048 | A | * | 12/1986 | Komatsu | 200/51.1 |
| 4,660,921 | A | * | 4/1987 | Hauver | 439/578 |
| 4,681,390 | A | * | 7/1987 | Hayward | 439/578 |
| 5,011,440 | A | * | 4/1991 | Lee | 439/857 |
| 5,096,444 | A | * | 3/1992 | Lu et al. | 439/750 |
| 5,150,087 | A | * | 9/1992 | Yoshie et al. | 333/185 |
| 5,278,525 | A | * | 1/1994 | Palinkas | 333/175 |
| 5,413,502 | A | * | 5/1995 | Wang | 439/551 |
| 5,432,488 | A | * | 7/1995 | Kotani et al. | 333/167 |
| 5,498,175 | A | * | 3/1996 | Yeh et al. | 439/578 |
| 5,625,177 | A | * | 4/1997 | Yukinori et al. | 200/1 R |
| 5,632,637 | A | | 5/1997 | Diener | |
| 5,658,171 | A | * | 8/1997 | Pauza et al. | 439/675 |
| 5,662,494 | A | * | 9/1997 | Zennamo et al. | 439/589 |
| 5,667,409 | A | * | 9/1997 | Wong et al. | 439/654 |
| 5,700,160 | A | * | 12/1997 | Lee | 439/578 |
| 5,730,622 | A | * | 3/1998 | Olson | 439/578 |
| 5,863,226 | A | * | 1/1999 | Lan et al. | 439/852 |
| 5,865,654 | A | * | 2/1999 | Shimirak et al. | 439/852 |
| 5,921,793 | A | | 7/1999 | Phillips | |
| 5,980,326 | A | * | 11/1999 | Weidner et al. | 439/675 |
| 6,030,240 | A | * | 2/2000 | Duff | 439/188 |
| 6,065,997 | A | * | 5/2000 | Wang | 439/578 |
| 6,071,144 | A | * | 6/2000 | Tang | 439/426 |
| 6,113,431 | A | * | 9/2000 | Wong | 439/638 |
| 6,123,581 | A | * | 9/2000 | Stabile et al. | 439/578 |

(Continued)

*Primary Examiner* — Ross Gushi
(74) *Attorney, Agent, or Firm* — Paul D. Chancellor; Ocean Law

(57) ABSTRACT

A coaxial connector with an F female waveguide is configured to limit exchange of certain RF signals.

14 Claims, 19 Drawing Sheets

(56) References Cited

U.S. PATENT DOCUMENTS

| | | | | |
|---|---|---|---|---|
| 6,146,168 | A * | 11/2000 | Ishii | 439/188 |
| 6,146,208 | A * | 11/2000 | Pennell | 439/675 |
| 6,227,868 | B1 * | 5/2001 | Wlodarski | 439/63 |
| 6,250,960 | B1 * | 6/2001 | Youtsey | 439/578 |
| 6,276,970 | B1 * | 8/2001 | Wong | 439/638 |
| 6,296,492 | B1 * | 10/2001 | Fujimoto et al. | 439/63 |
| 6,299,479 | B1 * | 10/2001 | Tang | 439/578 |
| 6,323,743 | B1 * | 11/2001 | Zelenz et al. | 333/185 |
| 6,336,820 | B2 * | 1/2002 | Hida | 439/188 |
| 6,380,826 | B1 * | 4/2002 | Palinkas | 333/175 |
| 6,398,568 | B1 * | 6/2002 | Preece et al. | 439/188 |
| 6,439,906 | B1 * | 8/2002 | Gray et al. | 439/188 |
| 6,476,688 | B2 * | 11/2002 | Palinkas | 333/175 |
| 6,520,785 | B2 * | 2/2003 | Hida | 439/188 |
| 6,574,855 | B1 * | 6/2003 | Hida | 29/622 |
| 6,595,799 | B2 * | 7/2003 | Yao | 439/578 |
| 6,636,129 | B2 * | 10/2003 | Zennamo et al. | 333/176 |
| 6,655,991 | B2 * | 12/2003 | Heebe et al. | 439/578 |
| 6,659,784 | B1 * | 12/2003 | Klein et al. | 439/188 |
| 6,674,343 | B2 * | 1/2004 | Gould et al. | 333/185 |
| 6,755,665 | B2 * | 6/2004 | Lu | 439/63 |
| 6,791,436 | B2 * | 9/2004 | Zennamo et al. | 333/185 |
| 6,794,957 | B2 * | 9/2004 | Shafer et al. | 333/185 |
| 6,808,405 | B1 * | 10/2004 | Uratani et al. | 439/188 |
| 6,808,426 | B2 * | 10/2004 | Liu | 439/654 |
| 6,829,813 | B2 * | 12/2004 | Zennamo et al. | 29/592.1 |
| 6,835,095 | B2 * | 12/2004 | Chen | 439/578 |
| 6,875,024 | B2 * | 4/2005 | Nagano | 439/63 |
| 6,881,082 | B2 * | 4/2005 | Jordan et al. | 439/188 |
| 6,888,423 | B2 * | 5/2005 | Tresness et al. | 333/185 |
| 6,899,563 | B1 * | 5/2005 | Lee | 439/578 |
| 6,955,561 | B2 * | 10/2005 | Seymour et al. | 439/578 |
| 6,974,340 | B2 * | 12/2005 | Zech et al. | 439/188 |
| 6,976,884 | B1 * | 12/2005 | Lee | 439/638 |
| 6,986,666 | B2 * | 1/2006 | Benson et al. | 439/63 |
| 7,080,997 | B2 * | 7/2006 | Matsuo | 439/188 |
| 7,086,867 | B2 * | 8/2006 | Nakagawa et al. | 439/63 |
| 7,255,599 | B1 * | 8/2007 | Chawgo et al. | 439/578 |
| 7,303,439 | B1 * | 12/2007 | Montena | 439/620.03 |
| 7,306,484 | B1 * | 12/2007 | Mahoney et al. | 439/578 |
| 7,323,951 | B2 * | 1/2008 | Montena | 333/175 |
| 7,354,306 | B2 * | 4/2008 | Thorner | 439/578 |
| 7,371,977 | B1 * | 5/2008 | Preonas | 174/383 |
| 7,414,196 | B2 * | 8/2008 | Chawgo et al. | 174/74 R |
| 7,442,084 | B2 * | 10/2008 | Montena | 439/620.03 |
| 7,527,500 | B2 * | 5/2009 | Montena | 439/8 |
| 7,575,474 | B1 * | 8/2009 | Dodson et al. | 439/581 |
| 7,713,067 | B1 * | 5/2010 | Behrent | 439/63 |
| 7,731,512 | B1 * | 6/2010 | Montena et al. | 439/108 |
| 7,909,614 | B1 * | 3/2011 | Chang | 439/63 |
| 7,972,173 | B1 * | 7/2011 | Hyzin et al. | 439/578 |
| 8,043,118 | B1 * | 10/2011 | Lee | 439/578 |
| 8,083,544 | B2 * | 12/2011 | Chee | 439/578 |
| 8,162,672 | B2 * | 4/2012 | Huang | 439/63 |
| 8,172,617 | B2 * | 5/2012 | Peng | 439/620.03 |
| 8,298,020 | B1 * | 10/2012 | Chen | 439/852 |
| 8,454,395 | B2 * | 6/2013 | Xu et al. | 439/852 |
| 8,545,235 | B2 * | 10/2013 | Montena | 439/63 |
| 8,585,438 | B2 * | 11/2013 | Tang | 439/578 |
| 2003/0129873 | A1 * | 7/2003 | Heebe et al. | 439/578 |
| 2003/0181073 | A1 * | 9/2003 | Nagano | 439/63 |
| 2004/0198094 | A1 * | 10/2004 | Seymour et al. | 439/578 |
| 2005/0001697 | A1 * | 1/2005 | Gould et al. | 333/185 |
| 2005/0148236 | A1 | 7/2005 | Montena | |
| 2005/0162238 | A1 * | 7/2005 | Ho | 333/185 |
| 2005/0164525 | A1 * | 7/2005 | Benson et al. | 439/63 |
| 2005/0245104 | A1 * | 11/2005 | Nakagawa et al. | 439/63 |
| 2006/0246774 | A1 * | 11/2006 | Buck | 439/578 |
| 2007/0298653 | A1 * | 12/2007 | Mahoney et al. | 439/578 |
| 2009/0011628 | A1 | 1/2009 | Purchon | |
| 2009/0114424 | A1 | 5/2009 | Holland | |
| 2009/0181575 | A1 * | 7/2009 | Hung | 439/583 |
| 2010/0093211 | A1 * | 4/2010 | Sutter | 439/578 |
| 2010/0255721 | A1 | 10/2010 | Purdy et al. | |
| 2011/0045694 | A1 * | 2/2011 | Chee | 439/578 |
| 2011/0076885 | A1 * | 3/2011 | Shaw et al. | 439/582 |
| 2011/0117776 | A1 | 5/2011 | Burris et al. | |
| 2011/0244720 | A1 * | 10/2011 | Peng | 439/578 |
| 2012/0040555 | A1 * | 2/2012 | Shih et al. | 439/578 |
| 2013/0040481 | A1 * | 2/2013 | Vallely et al. | 439/312 |
| 2013/0115809 | A1 * | 5/2013 | Hanson et al. | 439/578 |
| 2013/0244481 | A1 * | 9/2013 | Holland et al. | 439/578 |
| 2013/0244483 | A1 * | 9/2013 | Montena | 439/578 |
| 2013/0244509 | A1 * | 9/2013 | Holland | 439/840 |
| 2013/0252462 | A1 * | 9/2013 | Tang | 439/578 |
| 2013/0266275 | A1 * | 10/2013 | Holland | 385/90 |
| 2013/0316578 | A1 * | 11/2013 | Takahashi et al. | 439/585 |

* cited by examiner

1200B

1200C

1300C

COAXIAL CONNECTOR WITH INGRESS REDUCTION SHIELD

PRIORITY CLAIM AND INCORPORATION BY REFERENCE

The present invention is a continuation-in-part of 1) U.S. Non-Provisional patent application Ser. No. 13/712,828 filed Dec. 12, 2012 which claims the benefit of 2) U.S. Provisional Patent Application 61/620,355 filed Apr. 4, 2012, both of which are entitled COAXIAL CONNECTOR WITH INGRESS REDUCTION SHIELD and both of which are herein incorporated by reference in their entireties and for all purposes.

BACKGROUND OF THE INVENTION

1. Field of the Invention

The present invention relates to an article of manufacture for conducting electrical signals. In particular, F-Type connectors are equipped to reject RF ingress.

2. Discussion of the Related Art

FIGS. 1, 2, 3A-C, and 4 show prior art F-Type connectors. FIG. 1 shows a perspective view 100 of a prior art F female port 102 mounted to a wall plate 104. FIG. 2 shows a side view 200 of FIG. 1 revealing a coaxial cable 208 attached via an F male connector 206 to the F female port and leaving a room facing attachment end 204 of the F female port exposed to stray signals and/or RF ingress 210.

FIGS. 3A-C show a cross-sectional view 300A, side view 300B and a perspective view 300C of a prior art F splice with female ports 332, 334 at opposed ends. This splice provides interconnected internal contacts 312, 314 for engaging respective coaxial cable center conductors and a body 316 for engaging F male connector couplings such as threaded nuts and having electrical continuity with respective coaxial cable outer conductors. The splice body 316, such as a metallic body, provides for transport of a coaxial cable ground signal.

Threads 322, 324 at opposing ends of the splice tubular body 316 provide a means for engaging F male connector couplings at the splice end ports. The splice assembly end ports 332, 334 typically include an inwardly directed shallow metal lip 342 that may be rolled from the body or provided in another fashion, for example by fixing a shallow ring at the tube end. The lip provides peripheral support to a disc shaped end insulator 344 within the splice body. An insulator central aperture 346 is for receiving a center conductor of a coaxial cable. Behind this insulator is the internal contact 312 (314) mentioned above.

FIG. 4 shows a cross-sectional view of a bulkhead port 400. To the extent that connector internals are insertable from only a single end, the connector may be referred to as "blind." The port has an F female port 432 at one end and a mount 450 at an opposed end. Similar to the splice above, the port includes an electrically conductive body 416, an internal contact 412 behind an insulator 444 held in place by a port end lip 442. An aperture 441 in the insulator provides for inserting a coaxial cable center conductor into the port contact 412 and body threads 422 provide for engaging an F male connector coupling such as a threaded nut.

Unlike the splice 300A-C, the bulkhead port 400 has a mount 450 at one end that may be separate from or include portions of a device/equipment bulkhead or portion(s) thereof. The mount supports the bulkhead port from a base 452. A contact 412 trailing portion 481 passes through a hole in a base insulator 456 and then through a hole 458 in the base.

As may be required, the base is insulated from the contact by an air gap or by another means known to skilled artisans.

These prior art connectors may become the source of future problems as proliferation of RF devices such as cellular telephones crowd RF spectra and increase the chances RF ingress will adversely affect interconnected systems such as cable television and satellite television signal distribution systems.

Persons of ordinary skill in the art have recognized that in cable television and satellite television systems ("CATV"), reduction of interfering radio frequency ("RF") signals improves signal to noise ratio and helps to avoid saturated reverse amplifiers and related optic transmission that is a source of distortion.

Past efforts have limited some sources of the ingress of interfering RF signals into CATV systems. These efforts have included increased use of traditional connector shielding, multi-braid coaxial cables, connection tightening guidelines, increased use of traditional splitter case shielding, and high pass filters to limit low frequency spectrum interfering signal ingress in active home CATV systems.

The F connector is the standard connection used for cable television and satellite signals in the home. For example, in the home one will typically find a wall mounted female F connector or a coaxial cable "drop" splitter or isolator for supplying a signal to the TV set, cable set-top box, or internet modem.

A significant location of unwanted RF signal and noise ingress into CATV systems is in the home. This occurs where the subscriber leaves a CATV connection such as a wall-mounted connector or coaxial cable drop connector disconnected/open. An open connector end exposes a normally metallically enclosed and shielded signal conductor and can be a major source of unwanted RF ingress.

As shown above, a CATV signal is typically supplied to a room via a wall mounted connector or in cases a simple "cable drop." These and similar cable interconnection points provide potential sources of unwanted RF signal ingress into the CATV system. As will be appreciated, multiple CATV connections in a home increase the likelihood that some connections will be left unused and open, making them a source of unwanted RF ingress. And, when subscribers move out of a home, CATV connections are typically left open, another situation that invites RF ingress in a CATV distribution system.

Known methods of eliminating unwanted RF ingress in a CATV system include placing a metal cap over each unused F connector in the home or, placing a single metallic cap over the feeder F port at the home network box. But, the usual case is that all home CATV connections are left active, and when unused, open, a practice the cable television operators and the industry have accepted in lieu of making costly service calls associated with new tenants and/or providing the CATV signal in additional rooms.

The inventor's work in this area suggests current solutions for reducing unwanted RF ingress resulting from open connectors are not successful and/or not widely used. Therefore, to the extent the CATV industry comes to recognize a need to further limit interfering RF ingress into CATV systems, it is desirable to have connectors that reduce RF ingress when they are left open.

Prior art exists which attempts to accomplish this goal but is generally thought to be prohibitively expensive, impractical, or mechanically unreliable. For example, one prior art method disclosed in patent applications of the present inventor disconnects the center conductor contact when the F female is not connected to a male connector. Another method is disclosed in U.S. Pat. No. 8,098,113 where an electronic method differentially cancels noise common to both the center conductor and shield and requires an electric power source. These methods are relatively expensive compared with at least some embodiments of the present invention. They also have reliability limitations due to either of included mechanical or electrical elements.

Presently, it appears the industry has little interest in RF ingress reduction solutions similar to those proposed herein. However, in the inventor's view, there are good reasons to pursue the invention herein to maintain signal quality.

SUMMARY OF THE INVENTION

The present invention provides a shield against unwanted radio frequency ("RF") signal transfer in coaxial cable installations. Shielding devices of the present invention include electromagnetic radiation shields such as waveguides and particularly dimensioned waveguides adapted to function in conjunction with coaxial cable connectors.

Electromagnetic shields include devices causing electric charges within a metallic shield to redistribute and thereby cancel the field's effects in a protected device interior. For example, an interior space can be shielded from certain external electromagnetic radiation when effective materials(s) and shield geometry(ies) are used.

Applications include cavity openings that are to be shielded from ingress, or in cases, egress, of certain RF signals or noise with an appropriate shield located at the opening. Effective shields include perforated structures such as plates, discs, screens, fabrics, perforated plates, and perforated discs. In effect, these shields are waveguide(s) tending to attenuate and/or reject passage of certain frequencies.

In the context of a coaxial cable connector, connector internal conductors or portions thereof may act as antennas to receive unwanted RF signals and/or noise via connector openings.

Coaxial cable connectors can be shielded from unwanted RF ingress even when a coaxial cable connector end is left open, for example when an F female port or connector end is left open. In various embodiments, unwanted RF ingress is restricted in a coaxial connector by, inter alia, appropriately selecting waveguide geometry including in some embodiments the size of a waveguide central aperture.

In various embodiments, coaxial cable connector waveguides are electrical conductors such as plates and fabrics. Plates include discs and in particular generally circular discs. Fabrics include meshes and weaves. Exemplary RF screens are made from a conducting material and have opening size(s) and thickness(es) that are effective to preferentially block RF ingress such as RF ingress in a particular frequency band. Suitable waveguide materials generally include conductors and non-conductors intermingled, commixed, coated, and/or impregnated with conductors.

Incorporated by reference herein in its entirety and for all purposes are the exemplary shield technologies described in U.S. Pat. No. 7,371,977 to inventor Preonas, including in particular the shields of FIGS. 2 and 3 and shield design considerations of FIG. 4. As skilled artisans will recognize, analytical shield and waveguide design methods are generally available and include code incorporating Faraday's Law and finite element modeling techniques. Use of these well-known tools by skilled artisans will typically provide good approximations of shield design variables for particular specifications including waveguide aperture size, thickness, and choice of material.

Inventor experiments on some prototype waveguide designs generally showed a) increasing waveguide thickness tended to increase connector impedance and b) increasing aperture size tended to reduce RF shielding.

Embodiments of the present invention provide solutions to problematic RF ingress into CATV distribution systems via inadequately shielded and/or open ended coaxial cable connectors subject to unwanted RF transfer. Embodiments of the invention limit unwanted RF signal transfer into media and media distribution systems such as CATV distribution systems.

As will be appreciated, embodiments of the invention disclosed herein have application to additional frequency bands and signal types. In various embodiments, providing waveguides made using effective material(s), hole size(s), and thickness(s) enables wide adaptation for mitigating unwanted signal ingress in selected frequency bands.

Various embodiments of the invention provide for waveguides with a generally annular structure and incorporating RF shielding material for shielding against undesired ingressing, or, in cases, egressing signals at frequencies in ranges below 100 MHz and at frequencies reaching 2150 MHz. Waveguide aperture shapes may be circular or other such as polygonal, curved, multiple curved, and the like. Aperture sizes include those with opening areas equivalent to circular diameters of 1.5 to 3 mm and aperture thicknesses include thicknesses in the range 0.5 to 2.0 mm. In some implementations, connectors with waveguides utilize apertures that are integral with a connector body or a disc/barrier that is within a portion of the connector such as a disk/barrier placed inside a connector body entry but before a connector coaxial cable center conductor contact. Suitable waveguide materials and structures include those known to skilled artisans such as metal waveguides and waveguides that incorporate surface and/or internal shielding materials including those described below.

An embodiment of the invention provides an aperture 2 to 3.5 mm with a nominal thickness between 0.5 to 1.5 mm. This combination of hole size and thickness acts as a waveguide to restrict ingress of low frequencies, typically under 100 Mhz by 20-40 dB (in some cases 1/100 of the signal) of that of an open-ended F port (See FIG. 9).

The combination of sizes serves to restrict the low frequency ingress while only minimally reducing the impedance of the operational connector interface. The reduced impedance match (sometimes characterized in terms of return loss) of the invention remains within limits acceptable to the CATV industry. As the aperture size grows beyond 3.5 mm, there is typically less shielding against unwanted signals at the connector entry.

A purpose of some embodiments of the invention is to maximize the RF shielding or ingress at low frequency while providing a good impedance match of the connector interface during operation. The inventor found that the thickness of the end surface or shield disc can also be an important factor in some embodiments. For example, thicknesses in the range of 0.5 to 1.5 mm were found to be effective in blocking frequencies under 100 Mhz.

An embodiment of the invention uses a 2 mm aperture or end hole size. And, some embodiments use tuned slots in addition to the 2 to 3.5 mm aperture. These slots or waveguide bars may be added to the port end surface or to an internal shield disc for specific frequency restriction.

An embodiment of the invention uses a shield disc from a polymer or ceramic material that can be coated or impregnated with a magnetic material active at specific frequencies. In addition to being homogeneously mixed with the ceramic or polymer, the material can be deposited or sputtered on the shield disc surface in different thicknesses or patterns to better affect specific frequencies. The shield may be a combination of waveguide and sputters or deposited material to more economically produce the shield. Discs made of two or more materials can be described as hybrid discs.

In various embodiments, the invention comprises: an outer connector body; a female end of the connector is for engaging a male coaxial cable connector; the connector female end having a waveguide with an aperture for receiving a center conductor of a coaxial cable; wherein the diameter of the aperture is in the range 1.3 mm to 3.0 mm; and, wherein the waveguide is configured to shield connector body internals from ingress of radio frequency signals in the range of 10 to 100 megahertz.

And, in some embodiments, the connector further comprises: a waveguide surface; the waveguide surface bordering the aperture and an aperture centerline about perpendicular to the waveguide surface; the thickness of a waveguide surface measured along a line parallel to the aperture centerline is not less than 0.5 mm; and, the thickness of the waveguide surface measured along a line parallel to the aperture centerline is not more than 1.5 mm.

And, in some embodiments, the connector further comprises: wherein the diameter of the aperture and the thickness of the waveguide are selected in a manner consistent with achieving a connector impedance of 75 ohms. And, in some embodiments, the connector further comprises: a rim of the outer connector body; and, the waveguide formed by the rim. And, in some embodiments the connector alternatively comprises: a rim of the outer connector body; and, the waveguide formed by a disc held in place by the rim.

And, in various embodiments, the invention comprises: an outer connector body; a female end of the connector is for engaging a male coaxial cable connector; the connector female end having a waveguide with an aperture for receiving a center conductor of a coaxial cable; the diameter of the aperture is not less than two times the diameter of the center conductor; the diameter of the aperture is not more than 4 times the diameter of the center conductor; and, wherein the waveguide is configured to shield connector body internals from ingress of radio frequency signals in the range of 10 to 100 megahertz while maintaining a nominal connector impedance of 75 ohms.

And, in some embodiments, the connector further comprises: a waveguide surface; the waveguide surface bordering the aperture and an aperture centerline about perpendicular to the waveguide surface; the thickness of a waveguide surface measured along a line parallel to the aperture centerline is not less than 0.5 mm; and, the thickness of the waveguide surface measured along a line parallel to the aperture centerline is not more than 1.5 mm.

And, in some embodiments, the connector further comprises: wherein the diameter of the aperture and the thickness of the waveguide are selected in a manner consistent with achieving a connector impedance of 75 ohms. And, in some embodiments, the connector further comprises: a rim of the outer connector body; and, the waveguide formed by the rim. And, in some embodiments, the connector alternatively comprises: a rim of the outer connector body; and, the waveguide formed by a disc held in place by the rim.

Yet other embodiments of the invention comprise a female F connector with an end opening body hole or separate entry disc behind the hole opening from 1.5 to 3 mm port with a thickness of 0.5 to 1.5 mm. In some embodiments, the disc is made from a metallic material and in some embodiments the disc is made from a metallically impregnated polymer or ceramic material. Some embodiments of the disc are made with additional waveguide slots and some embodiments of the disc are made including one or more of a polymer, ceramic, or fiberglass material for example with a sputtered or etched magnetic material on the surface.

As will be appreciated, embodiments of the invention disclosed herein have application to additional frequency bands and signal types. In various embodiments, providing waveguides made using effective material(s), hole size(s), and thickness(s) enables wide adaptation for mitigating unwanted signal ingress in selected frequency bands.

An embodiment of the invention provides an aperture 2 to 3.5 mm with a nominal thickness between 0.5 to 1.5 mm. This combination of hole size and thickness acts as a waveguide to restrict ingress of low frequencies, typically under 100 Mhz by 20-40 dB (in some cases 1/100 of the signal) of that of an open-ended F port (See FIG. 9).

The combination of sizes serves to restrict the low frequency ingress while only minimally reducing the impedance of the operational connector interface. The reduced impedance match (sometimes characterized in terms of return loss) of the invention remains within limits acceptable to the CATV industry. As the aperture size grows beyond 3.5 mm, there is typically less shielding against unwanted signals at the connector entry.

A purpose of some embodiments of the invention is to maximize the RF shielding or ingress at low frequency while providing a good impedance match of the connector interface during operation. The inventor found that the thickness of the end surface or shield disc can also be an important factor in some embodiments. For example, thicknesses in the range of 0.5 to 1.5 mm were found to be effective in blocking frequencies under 100 Mhz.

An embodiment of the invention uses a 2 mm aperture or end hole size. And, some embodiments use tuned slots in addition to the 2 to 3.5 mm aperture. These slots or waveguide bars may be added to the port end surface or to an internal shield disc for specific frequency restriction.

An embodiment of the invention uses a shield disc from a polymer or ceramic material that can be coated or impregnated with a magnetic material active at specific frequencies. In addition to being homogeneously mixed with the ceramic or polymer, the material can be deposited or sputters on the shield disc surface in different thicknesses or patterns to better affect specific frequencies. The shield may be a combination of waveguide and sputters or deposited material to more economically produce the shield.

BRIEF DESCRIPTION OF THE DRAWINGS

The present invention is described with reference to the accompanying figures. These figures, incorporated herein and forming part of the specification, illustrate embodiments of the invention and, together with the description, further serve to explain its principles enabling a person skilled in the relevant art to make and use the invention.

DESCRIPTION OF THE PREFERRED EMBODIMENTS

Figure 1:
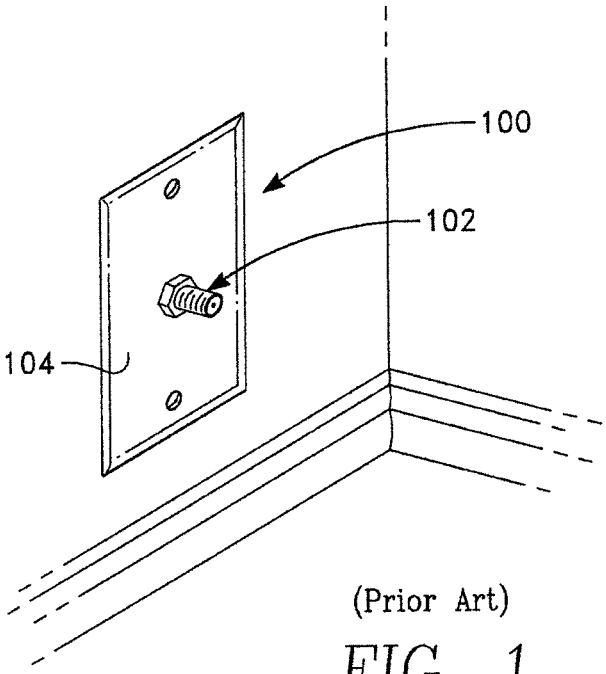
(Prior Art) FIG. 1
FIG. 1 shows a perspective view of a prior art F port and splice.
Figure 2:
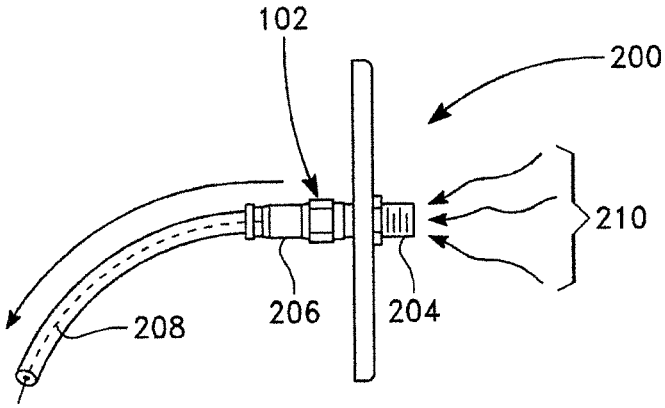
(Prior Art) FIG. 2
FIG. 2 shows a side view of FIG. 1.
Figure 3A:
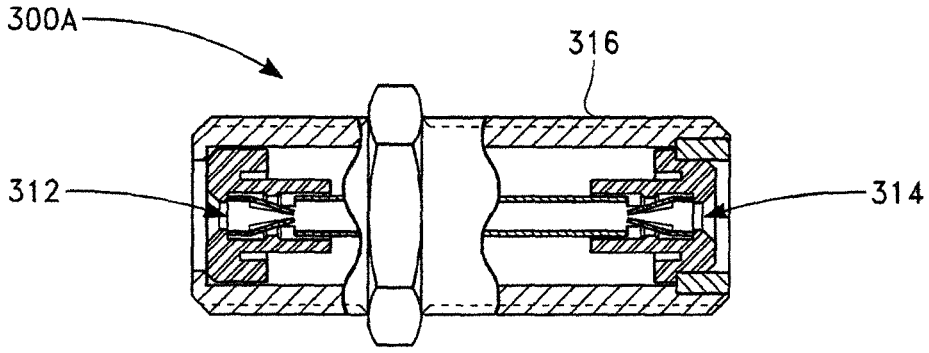
(Prior Art) FIG. 3A
FIG. 3A-C show prior art F splice views.
Figure 3B:
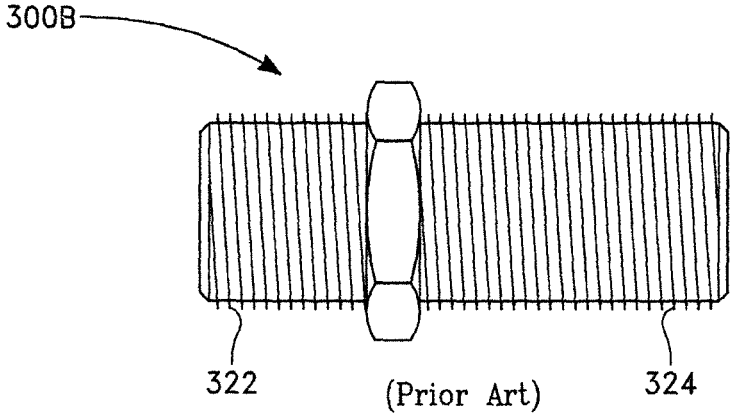
(Prior Art) FIG. 3B
Figure 3C:
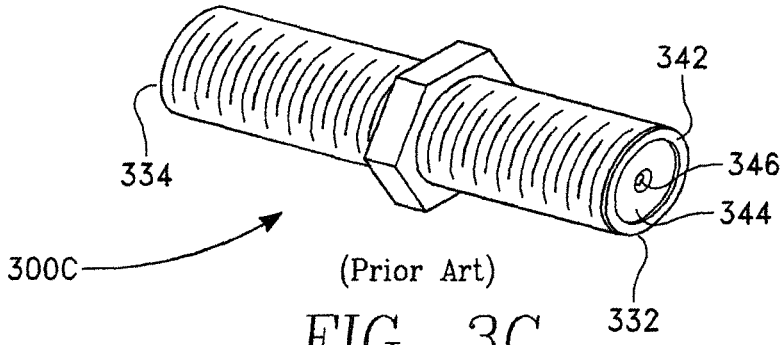
(Prior Art) FIG. 3C
Figure 4:
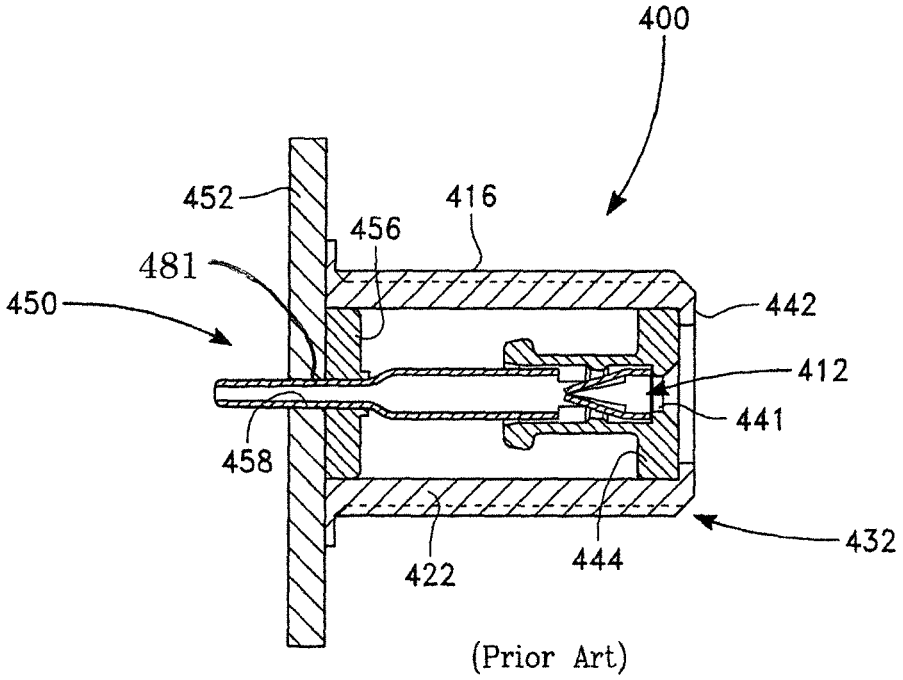
(Prior Art) FIG. 4
FIG. 4 shows a prior art bulkhead type F port.

The disclosure provided herein describes examples of some embodiments of the invention. The designs, figures, and descriptions are non-limiting examples of the embodiments they disclose. For example, other embodiments of the disclosed device and/or method may or may not include the features described herein. Moreover, disclosed advantages and benefits may apply to only certain embodiments of the invention and should not be used to limit the disclosed invention.

Embodiments of the invention provide a method of reducing RF cable interconnection ingress. In various embodiments, cable interconnection RF ingress is reduced by including a filter such as a waveguide and/or a screen at the cable entry end of an F-Type female port. Examples include filters that are frequency and/or frequency range specific.

Restriction of the ingress of RF frequencies may be for particular applications such as restricting frequencies below 100 MHz for CATV applications and specific frequencies for satellite and home networking. Because ingress restriction devices may change an F connector's characteristic impedance, for example 75 Ohm devices, filter geometry may be varied to balance filter performance and maintenance of a desired characteristic impedance within an acceptable range.

Notably, typical F female port geometry includes entry hole sizes that range from 4.0-5.5 mm as compared with the F connector tube or body overall diameter of 9.7 mm (⅜-32 outer thread). CATV industry standards promulgated by the Society of Cable Television Engineers ("SCTE") show a minimum port opening of 4.3 mm to insure desired connector impedance when, for example, they cannot control the corresponding annular end wall thickness. By selecting filter performance related dimensions and materials, embodiments of the present invention reduce stray signal ingress while maintaining particular return loss performance such as an SCTE recommended minimum return loss of 20 dB.

Applicant notes that in telecommunications, return loss is the loss of signal power resulting from the reflection caused by a discontinuity in a transmission line. This discontinuity can be a mismatch with the terminating load or with a device inserted in the line.

$$RL(\text{dB}) = 10 \log_{10} \frac{P_i}{P_r}$$

Return loss is usually expressed in decibels dB where RL(dB) is the return loss in dB, $P_i$ is the incident power and $P_r$ is the reflected power. Return loss is related to both standing wave ratio (SWR) and reflection coefficient (Γ). Increasing return loss corresponds to lower SWR. Return loss is a measure of how well devices or lines are matched. A match is good if the return loss is high. A high return loss is desirable and results in a lower insertion loss.

In some embodiments, the invention provides a waveguide in the form of a waveguide "washer," that is an electrically conductive disc with a central hole. In an embodiment, a waveguide aperture or entry hole diameter is in the range of 2.0-2.5 mm and the waveguide thickness in the range of 0.5-1.5 mm. This particular combination of waveguide hole size and thickness provides a device for restricting ingress of frequencies typically below 100 MHz with significant attenuation. As used herein, the term disc includes structures such as a separator, a plate, a flat plate, a circular plate, a perforated plate, a disc, and a disk, any of which may be made from one or more of plates, fabrics, composites, and the like.

Embodiments provide RF ingress attenuation in the range of 20-40 dB (reductions to 1/100 of the signal) when compared with RF ingress of an open-ended F female port without the waveguide or other RF ingress protection. Persons of ordinary skill in the art will recognize waveguide dimensions may be varied within and around the ranges to provide particular waveguide and connector performance.

Dimensions of waveguide aperture and thickness may be chosen to restrict RF ingress such as low frequency ingress managing the impedance of the operational connector interface. Embodiments of the invention perform with return losses acceptable in the CATV and satellite television industry. For example, where the waveguide aperture size is greater than 3 mm, RF ingress continues to be restricted to some degree but there is less shielding of the connector entry.

Embodiments of the invention may enhance RF shielding for ingress at low frequencies while providing a good impedance match of the connector interface while in operation. For example, various embodiments control the thickness of the end surface or shield disc to enhance performance. Waveguide thicknesses in the range of 0.5 to 1.5 mm have demonstrated an ability to block frequencies below 100 MHz.

Figure 5:
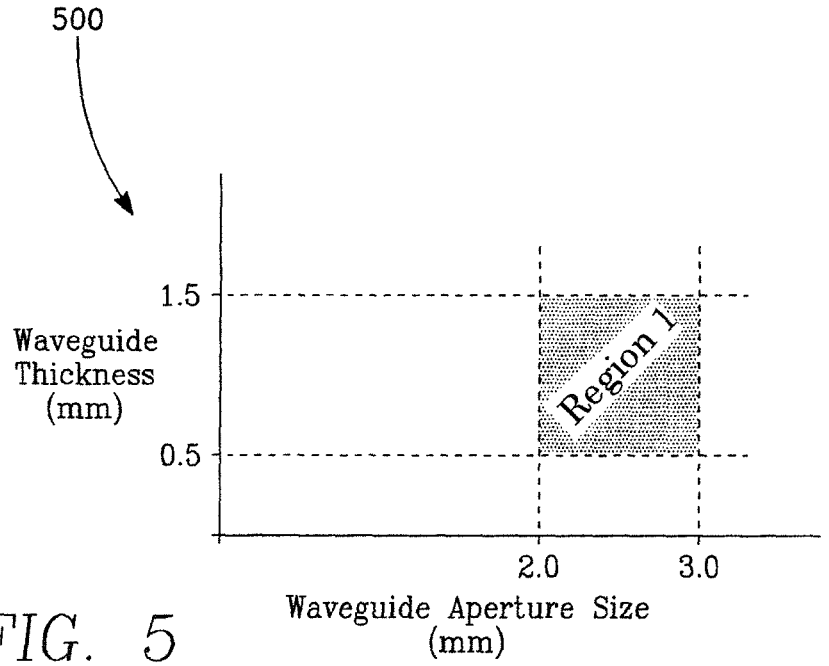
FIG. 5 shows a first chart of waveguide dimensions for some embodiments of the present invention.

FIG. 5 shows an exemplary chart of waveguide thickness and waveguide aperture size 500. In particular, the chart shows ranges of aperture size and thickness within a particular region, Region 1, that has been shown to yield desirable RF ingress attenuation in CATV applications.

FIG. 5 illustrates thickness and aperture size ranges tested in connection with rejecting unwanted signals in the frequency band 100 MHz and below. Region 1 is bounded by aperture sizes of approximately 2 to 3 mm and waveguide thicknesses of approximately 0.5 to 2 mm. Notably, beneficial rejection of unwanted signals in the frequency spectrum between 100 MHz and 2050 MHz has also been observed.

Several waveguides with dimensions in Region 1 were found to be useful for blocking unwanted RF ingress typical of CATV applications. For example, in various embodiments an F female connector is shielded to restrict RF transfer at frequencies below 100 MHz while allowing the connector to mate with a male coaxial connector with insignificant degradation of a desired 75 ohm impedance.

Figure 6:
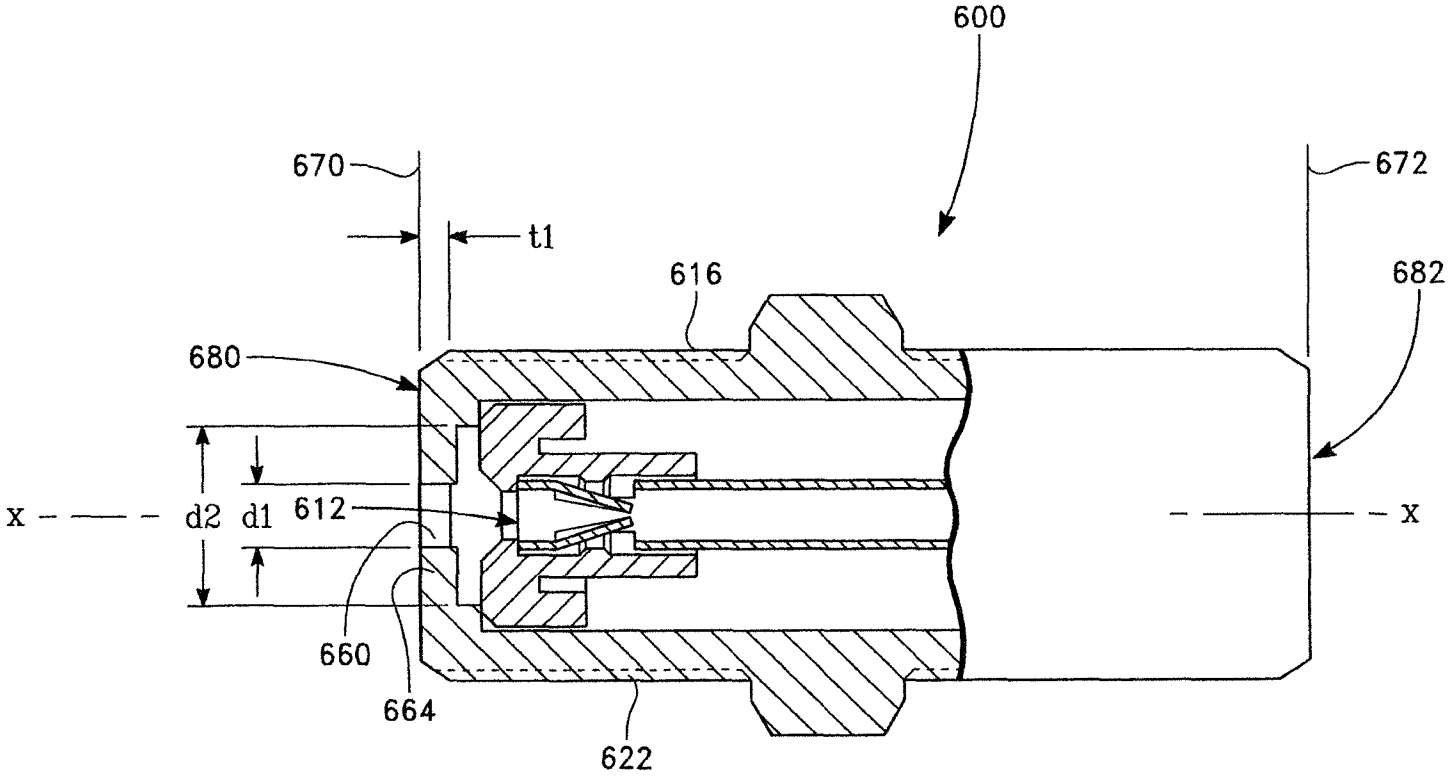
FIG. 6 shows in partial section a first embodiment of the connector with shield of the present invention.

FIG. 6 shows an F-Type splice embodiment of the present invention with an integral waveguide 600. A tubular, electrically conductive splice body 616 extends between first and second ends 670, 672 of the body locating two F female ports 680, 682. An outer diameter of the body is threaded 622 for engaging male connector(s).

A shielded port 680 with an internal contact 612 is located near the first end 670. The port is shielded by an integral waveguide in the form of an inwardly directed integral lip. Forming a centrally located and relatively small shielded port aperture 660 with diameter d1, the lip is deep as compared with prior art port lips. A lip diameter d2 (d2>d1) describes an annulus 664 between d1 and d2 having a thickness t1 measured along a central axis x-x of the connector.

Typically, only one end of the splice will have need of a shielded port given the opposite end usually remains attached to a mating male connector during the splice service life. As such, only the end opposite this undisturbed connection may typically be shielded.

In various embodiments the waveguide aperture has a diameter d1 that is smaller than the wavelength of stray RF signals to be attenuated before reaching the connector contact or other similar connector parts behind the waveguide. In various embodiments the waveguide has a thickness t1 in the range of 0.5 to 1.5 mm and an aperture diameter in the range of 2.0 to 3.0 mm. And, in various embodiments the waveguide aperture has a thickness t1 that is less than the aperture diameter (t1<d1). In an embodiment suited for use in some CATV applications, the inventor determined approximate dimensions t1=1.3 mm, d1=2.0 mm, and d2=5.5 mm provided significant attenuation of RF ingress frequencies below 100 MHz.

Figure 7:
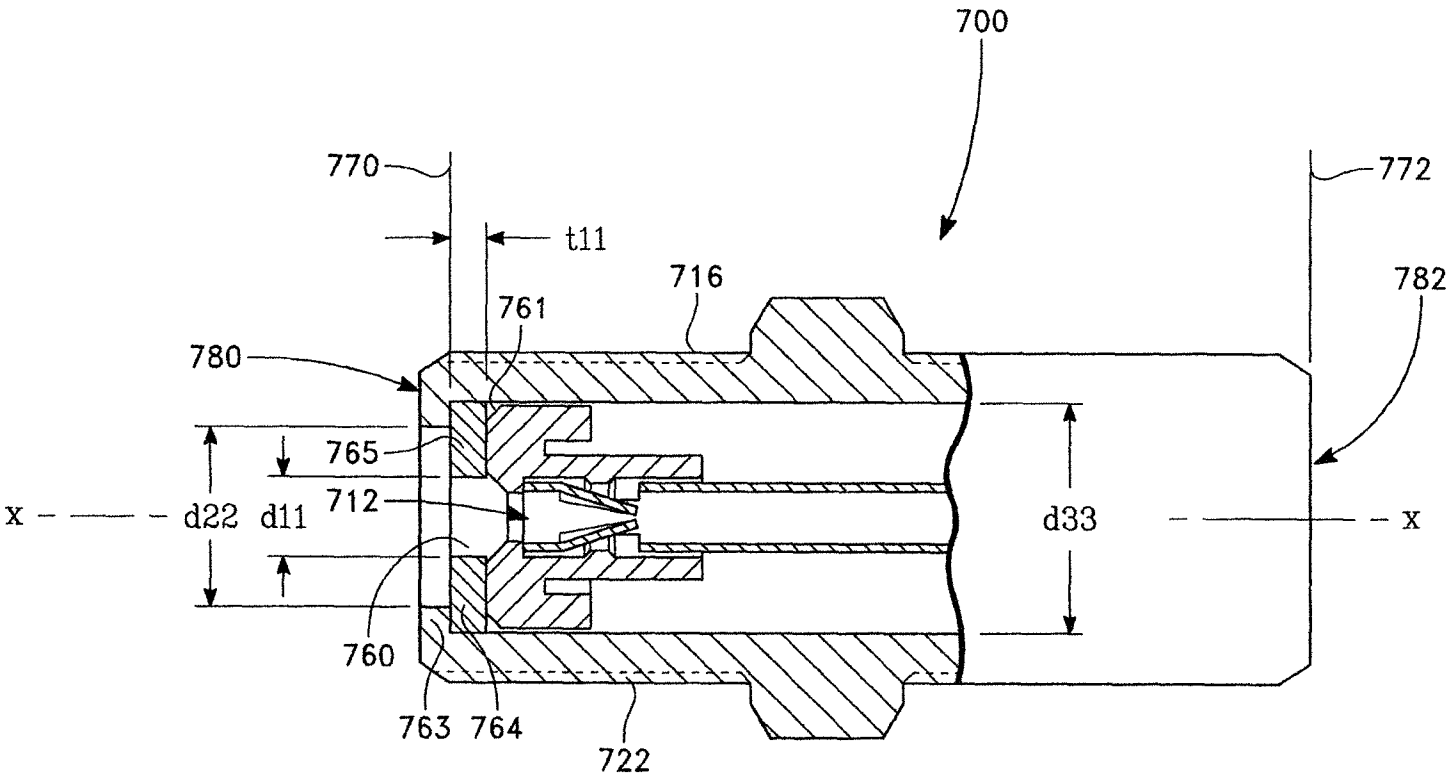
FIG. 7 shows in partial section a second embodiment of the connector shield of the present invention.

FIG. 7 shows an F-Type splice embodiment of the present invention with an disc waveguide 700. An electrically conductive splice body 716 extends between first and second ends 770, 772 of the body locating two F female ports 780, 782. An outer diameter of the body is threaded 722 for engaging male connector(s).

A shielded port 780 with an internal contact 712 is located near the first end 770. The port is shielded by a disc waveguide in the form of a perforated disc 764. As used here, disc includes any of thin or thick plates, relative to other plate dimensions, having a circular or another cross-sectional shape. As shown, the disc has an outer diameter d33 and a disc periphery 761 that is supported by an inwardly directed rim 763 of the connector body 716. As skilled artisans will appreciate, other methods of locating and/or supporting the disc may also be used.

The disc includes a relatively small and centrally located shielded port aperture 760 with diameter d11. The port aperture diameter d11 is less than an adjacent body end hole diameter d22. The disc defines an inwardly directed disc lip 765 that is deep as compared with prior art port lips and in some embodiments is coextensive with the disc 764. The disc has a thickness t11 measured along a central axis x-x of the connector. Typically, only one end of the splice will have need of a shielded port given the opposite end usually remains attached to a mating male connector during the splice service life. As such, only the end opposite this undisturbed connection may typically be shielded.

In various embodiments the waveguide aperture has a diameter d11 that is smaller than the wavelength of stray RF signals to be attenuated before reaching the connector contact or other similar connector parts behind the waveguide. In various embodiments the waveguide has a thickness t11 in the range of 0.5 to 1.5 mm and an aperture diameter in the range of 2.0 to 3.0 mm. And, in various embodiments the waveguide aperture has a thickness t11 that is less than the aperture diameter (t11<d11). In an embodiment suited for use in some CATV applications, the inventor determined approximate dimensions t11=1.3 mm, d11=2.1 mm, and d22=5.5 mm provided significant attenuation of RF ingress frequencies below 100 MHz.

Figure 8:
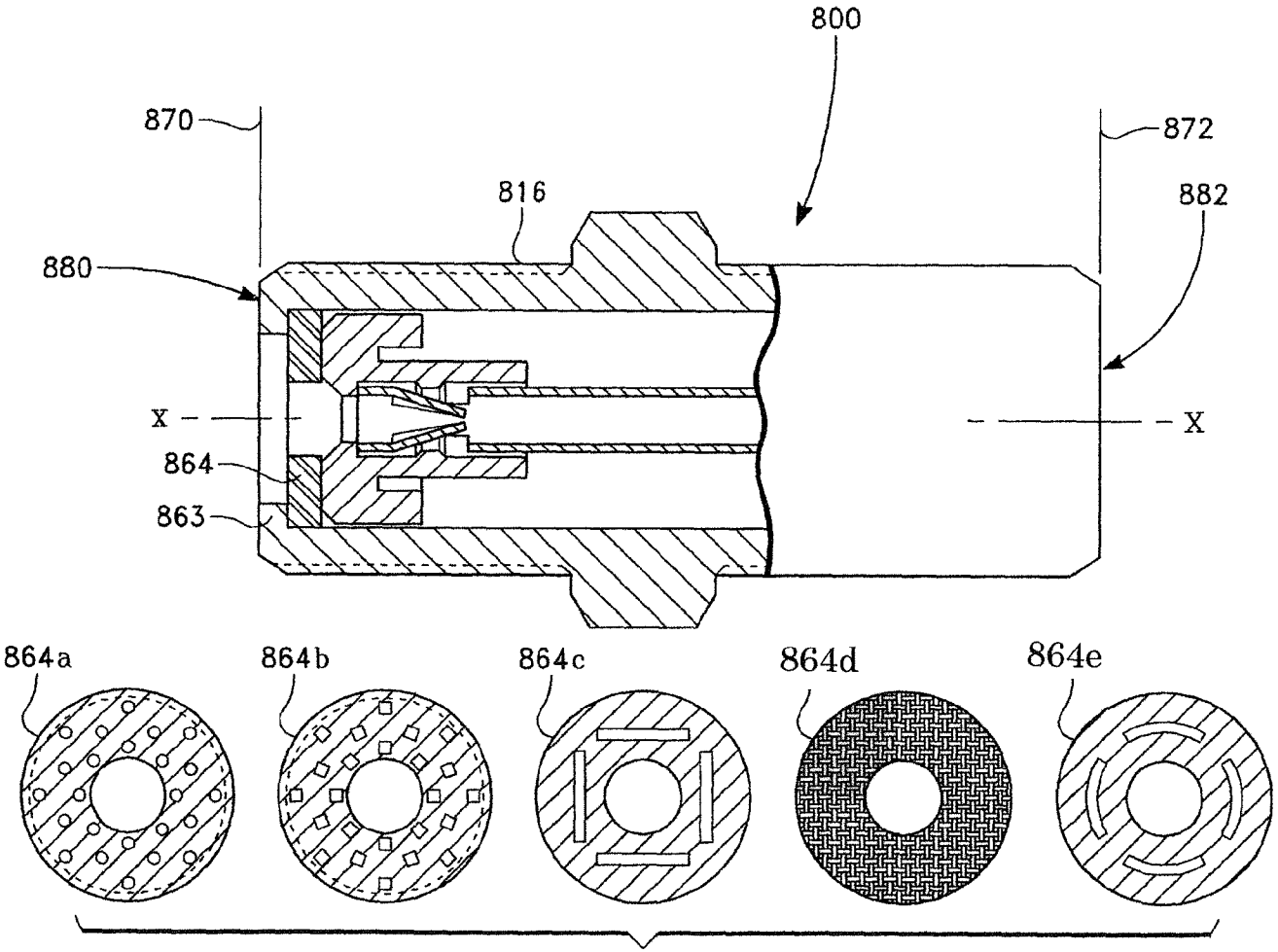
FIG. 8 shows the connector of FIG. 6 with a variety of waveguide discs.

FIG. 8 shows an F-Type splice embodiment of the present invention with a disc waveguide 800. A tubular, electrically conductive splice body 816 extends between first and second ends 870, 872 of the body locating two F female ports 880, 882.

As shown, an electrically conductive disc waveguide 864 is internal to the connector body 816 and is near a locating and/or supporting part such as an inwardly directed rim 863 of the connector body. As skilled artisans will appreciate, other methods of locating and/or supporting the disc may also be used. For example, a removable screw-in plug, circlip, or similarly useful device may retain the disc.

In addition to varying the size of a hole in a perforated disc such as a disc with a center hole, disc type waveguides may utilize a plurality of holes to obtain a desired performance. These holes may be of the same or different sizes and may include or exclude a center hole. Hole shapes may also be varied.

Five exemplary multi-hole discs 864*a-e* are shown in FIG. 8. A first disc 864*a* has circular center hole and additional smaller holes arranged along radii of the disc. A second disc 864*b* has a circular center hole and additional smaller rectangular or square holes arranged along radii of the disc. A third disc 864*c* has a circular center hole and comparatively narrow rectangular slots with a longitudinal axis about perpendicular to disc radii. A fourth disc 864*d* has a circular center hole and is made of a mesh with openings smaller than the centerole. The fifth disc 864*e* has a circular centerole and plural relatively small rectangular slots having longitudinal axes arranged about perpendicular to disc radii.

Figure 9:
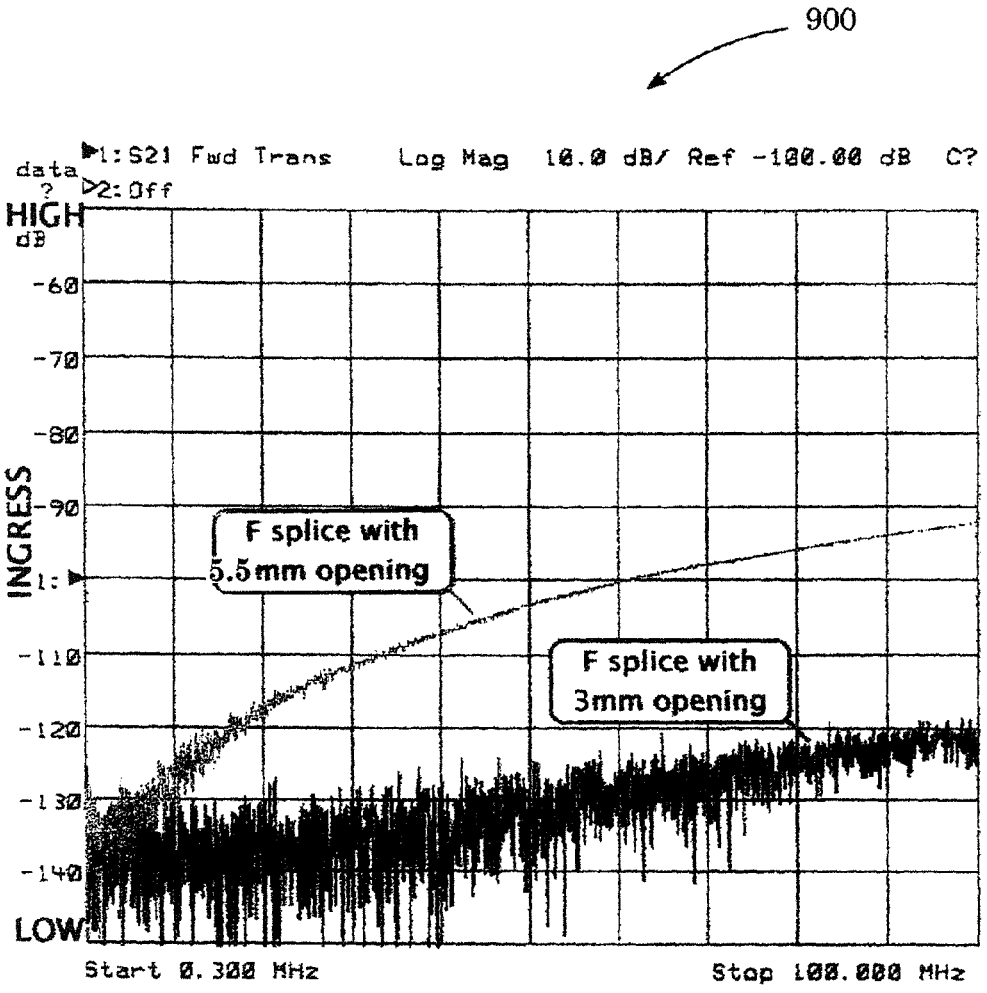
FIG. 9 shows a performance chart of one open connector embodiment of the present invention.

FIG. 9 shows performance graphs for open coaxial cable connector splices with different opening sizes 900. This chart is a digital recording of a test instrument display made during testing of a prototype connector with a port shielded in accordance with the present invention. The upper curve marked "F splice with 5.5 mm [aperture] opening" lacks the shield of the present invention and shows RF ingress that varies between about −140 dB and −90 dB over the ingress frequency range 0.3 to 100 MHz. The lower curve marked "F splice with 3 mm [aperture] opening" includes an embodiment of the shield of the present invention and shows ingress that is much reduced, varying between about −140 dB and −120 db over the same 0.3 to 100 Mhz range of RF ingress frequencies. As can be seen from the chart, improvements in the range of about 20-40 dB can occur over the range of frequencies tested.

Figure 10:
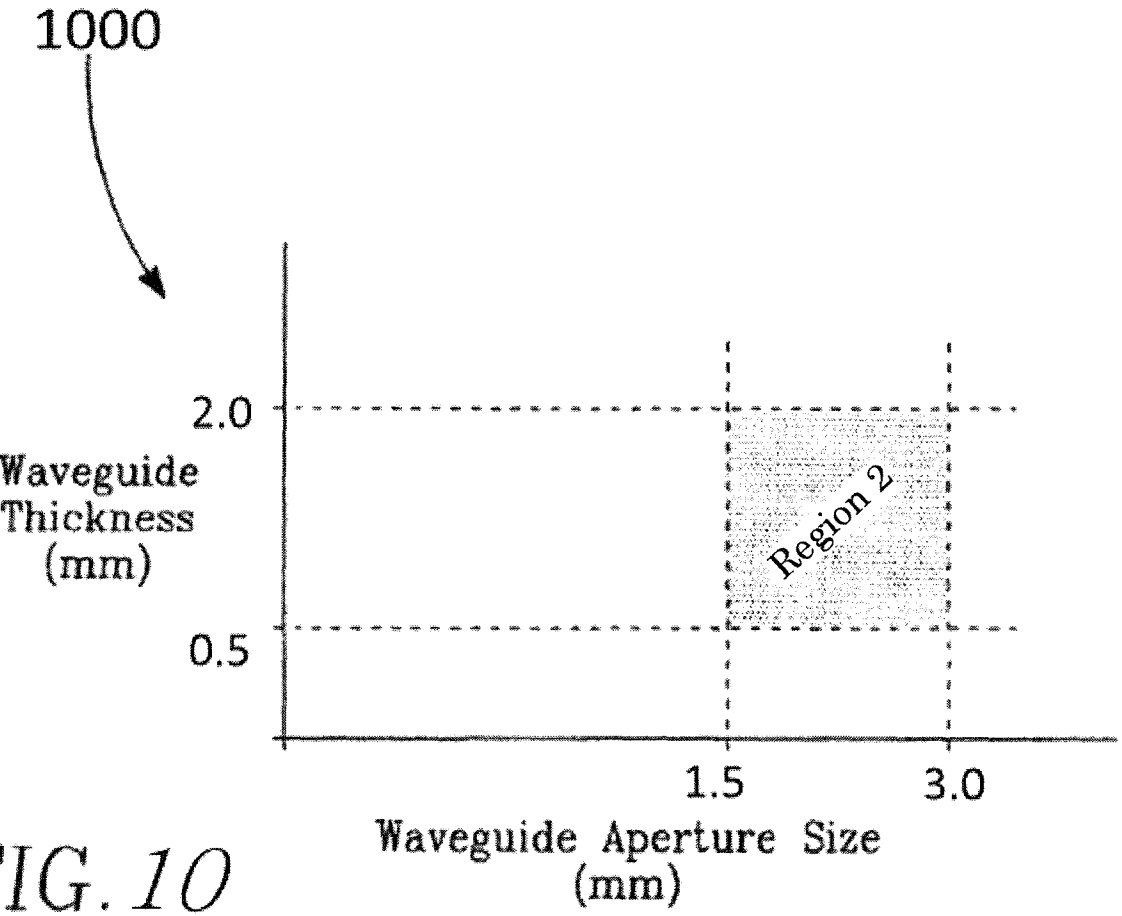
FIG. 10 shows a second chart of waveguide dimensions for some embodiments of the present invention.

FIG. 10 shows a second exemplary chart of waveguide thickness and waveguide aperture size 1000. In particular, the chart shows ranges of aperture size and thickness within a particular region, Region 2, that has been shown to yield desirable RF ingress attenuation in CATV applications. The figure illustrates thickness and aperture size ranges tested in connection with rejecting unwanted signals in CATV distribution frequency bands. Notably, beneficial rejection of unwanted signals in the frequency spectrum below 100 MHz and between 100 MHz and 2050 MHz has also been observed.

Here, the 0.3 to 1000 MHz and in particular the 700-800 MHz frequency band is of interest due to cellular telephone signal ingress such as 4G and/or LTE phone signal ingress in a cell phone/CATV an overlapping (700-800 MHz) frequency range. Region 2 is bounded by aperture sizes of approximately 1.5 to 3 mm and waveguide thicknesses of approximately 0.5 to 2 mm.

Figure 11A:
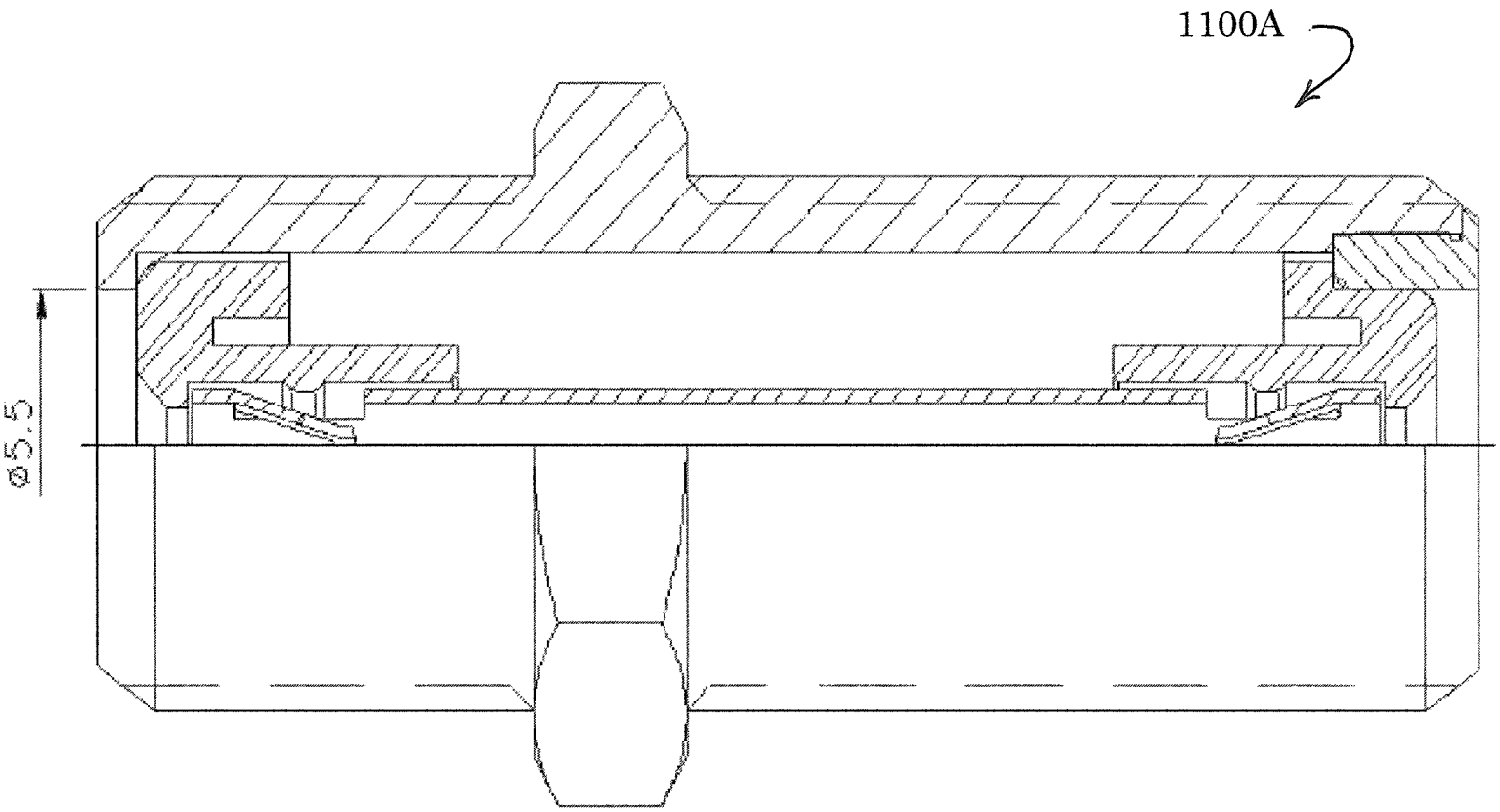
FIGS. 11A-B show a first coaxial cable connector and a related signal ingress performance chart.

FIG. 11A shows an F type splice 1100A with a 5.5 mm aperture, a feature that can be implemented, for example, by deforming the end of the splice body to form an inwardly directed lip that defines the aperture.

Figure 11B:
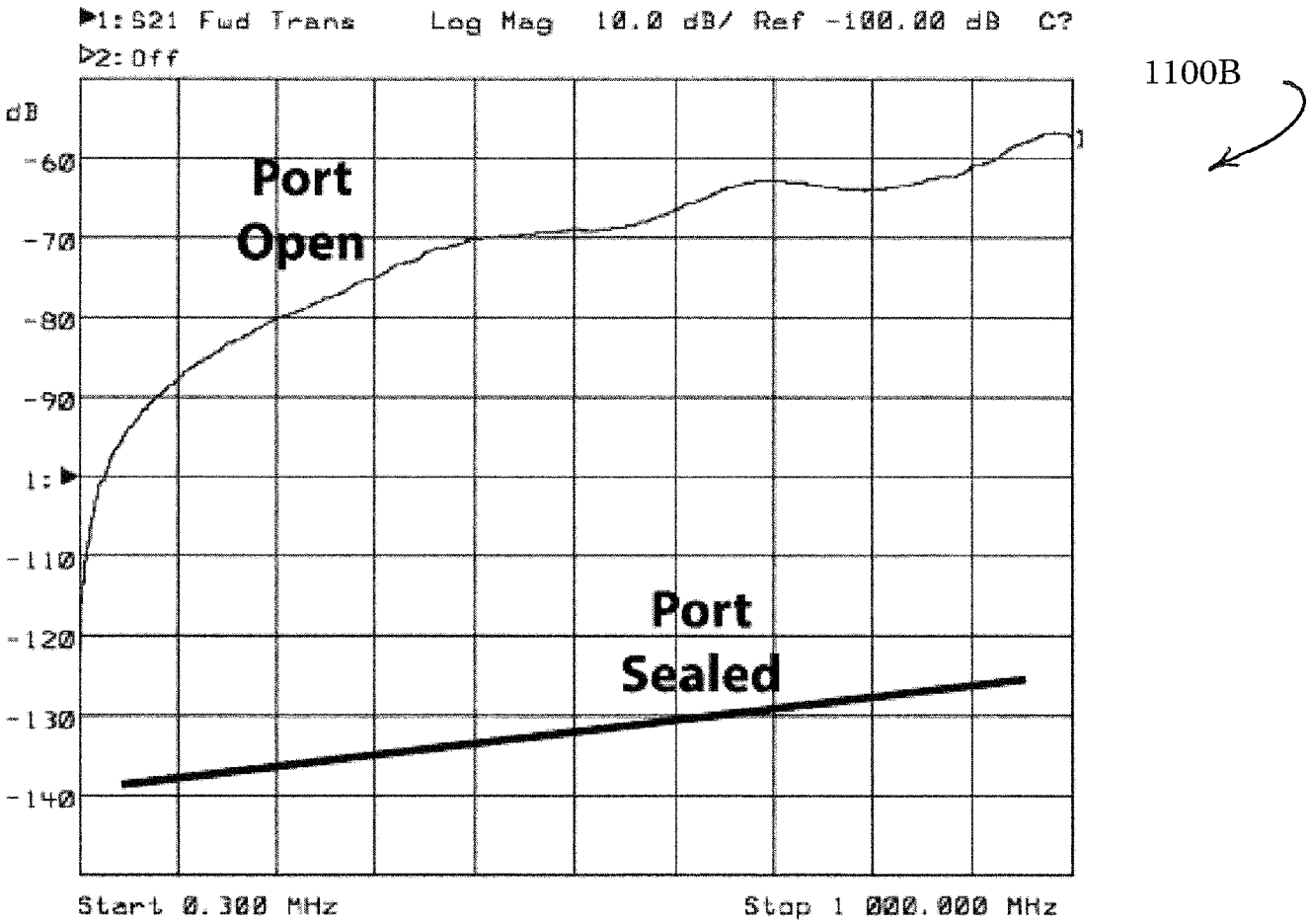

FIG. 11B shows attenuation performance 1100B of the splice of FIG. 11A under two different conditions. Larger negative dB values are desirable as they indicate greater attenuation of undesirable ingressing signals. The upper curve of this graph shows the port open condition, for example when the splice is mounted in a wall plate as shown in FIG. 1. Port open means the exposed port of the splice is disconnected while the hidden/in-the-wall port of the splice is connected to a CATV distribution system. The lower curve of this graph shows the port closed condition, for example when the above described exposed port is capped as with a screw-on cap, to block signal ingress. Differences between port open and port closed performance are shown in the table below.

| Performance With 5.5 mm Aperture, Connector of FIG. 11A | | |
|---|---|---|
| | 0.300 MHz | 1000 MHz |
| Port Open | −120 dB | −63 dB |
| Port Closed | −138 dB | −125 dB |

Connectors similar to those of FIGS. 12A and 13A below have been tested and found to significantly attenuate undesirable ingressing signals in the 0.3 to 1000 MHz frequency range and in particular in the 700-800 MHZ frequency range. And, as the data shows, the waveguides reject unwanted signals while maintaining return loss values suited to CATV industry operations.

Figure 12A:
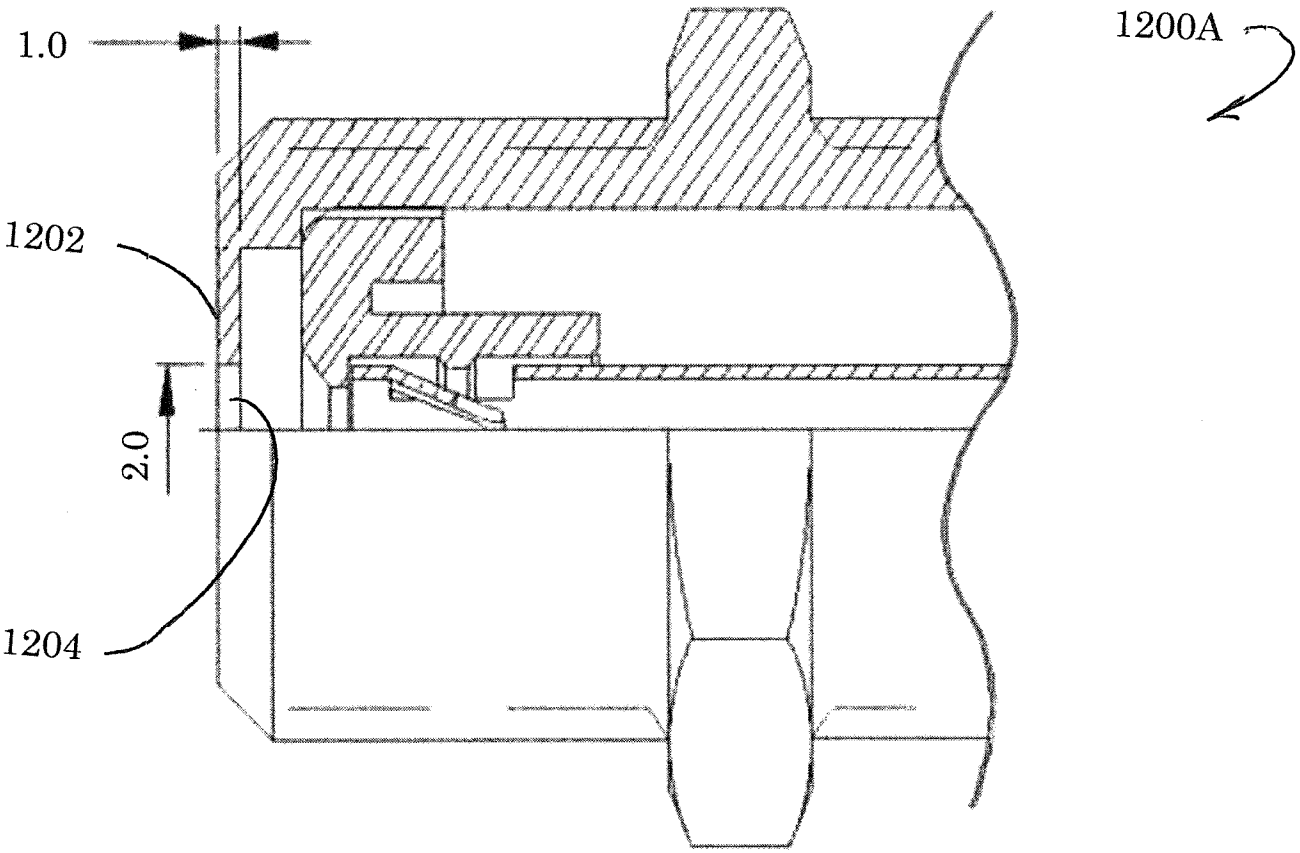
FIGS. 12A-C show a second coaxial cable connector and related performance charts.

FIG. 12A shows a portion of a coaxial cable connector with a waveguide 1200A. The waveguide 1202 is 1.0 mm thick and has a central aperture 1204 that is 2.0 mm in diameter. Notably, other than circular apertures may be used in various embodiments. For example, a triangular or other aperture shape with a similar cross-sectional area might be used here in lieu of the circular aperture.

Figure 12B:
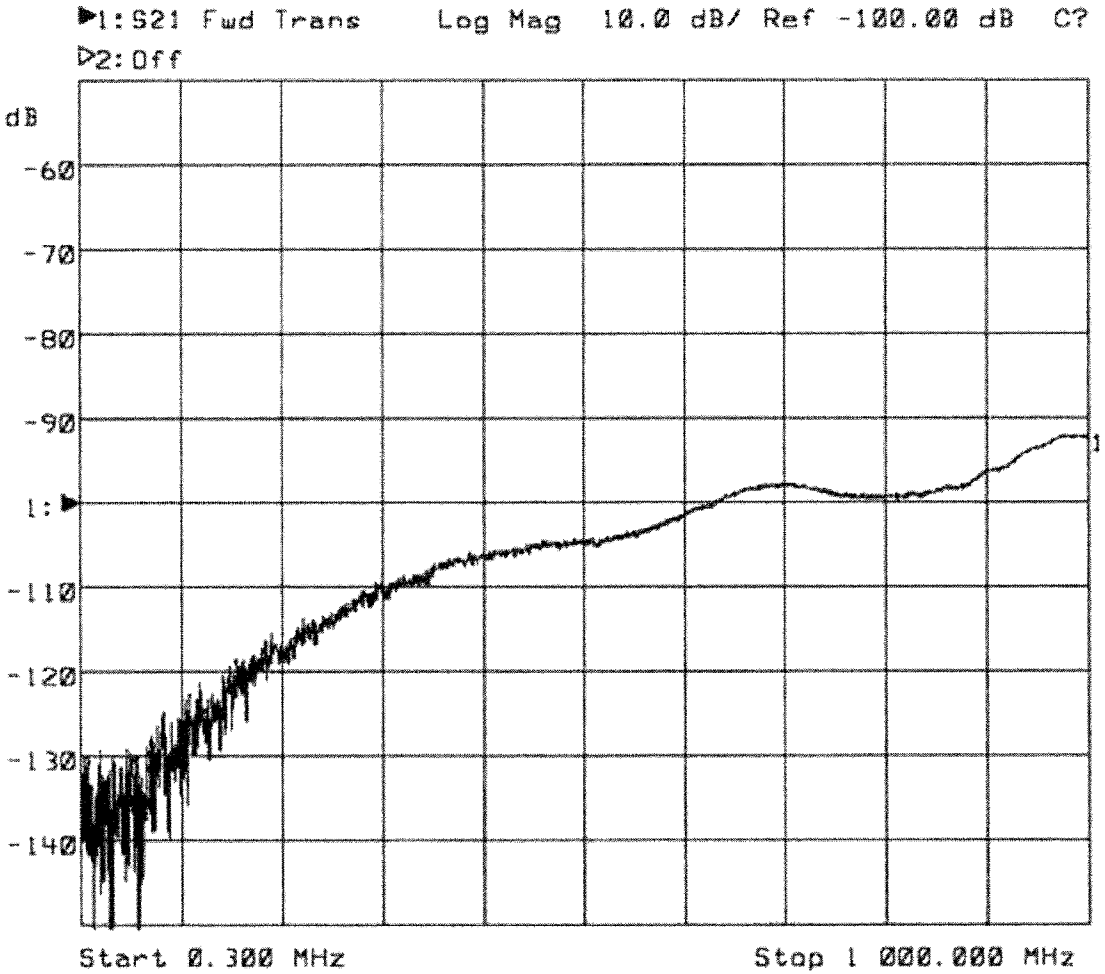

FIG. 12B shows attenuation performance 1200B of the protected connector of FIG. 12A.

| Performance with 2.0 mm Aperture, Connector of FIG. 12A | | |
|---|---|---|
| | 0.300 MHz | 1000 MHz |
| Port Open | −140 dB | −92 dB |
| Improvement Over Connector of FIG. 11A | (−140 − (−120)) = −20 dB | (−92 − (−63)) = −29 dB |

As seen, in the 0.300 MHz to 1000 MHz frequency spectrum, improved attenuation of unwanted ingressing signals is in the range of about −20 to −29 dB.

Figure 12C:
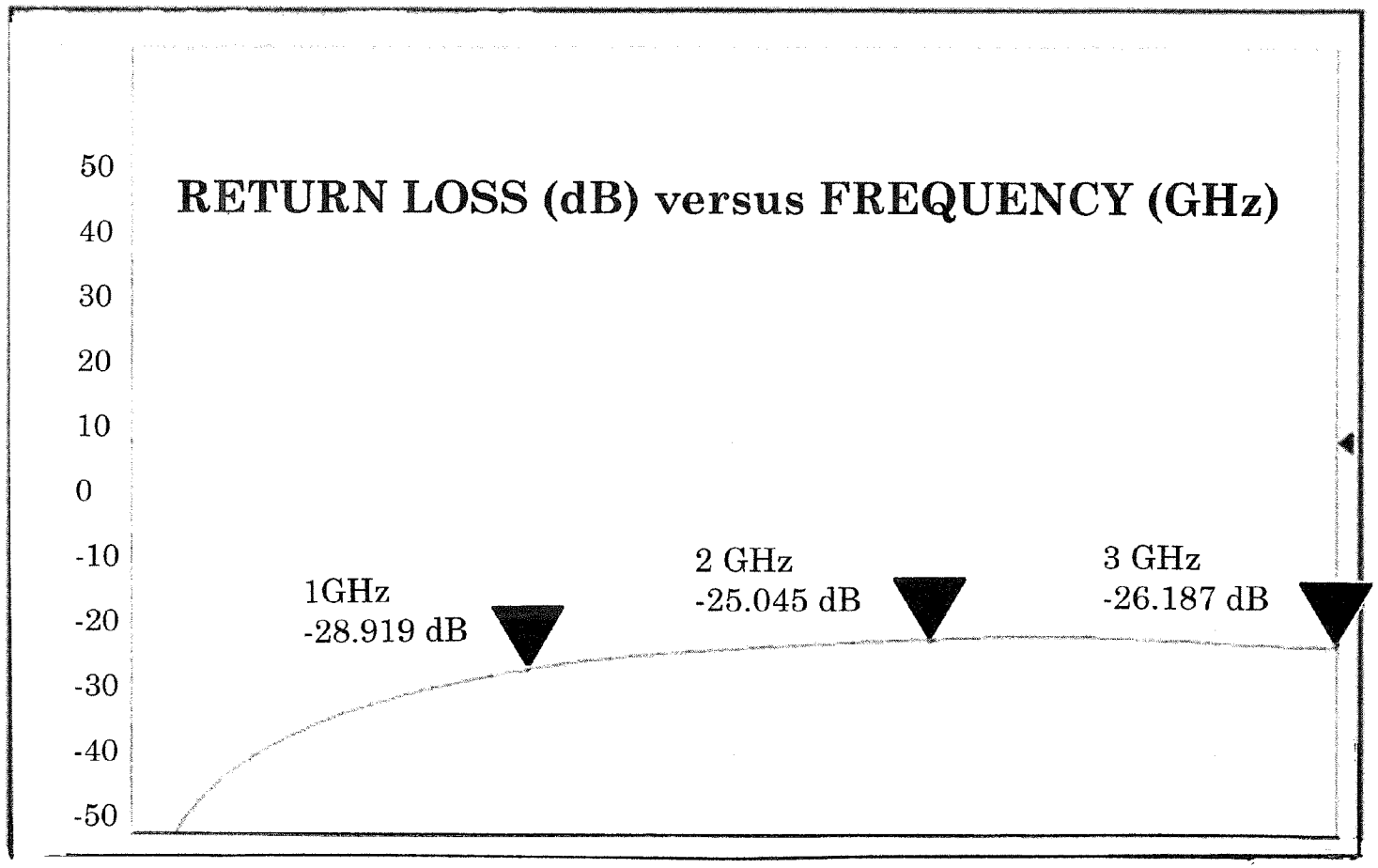

FIG. 12C shows return loss performance 1200C of the protected connector of FIG. 12A. Larger negative dB values of return loss are desirable as they indicate improved impedance matching and reduced signal reflection losses. Typical return loss values maintained in the CATV industry are in the range of about −50 to −10 dB. As seen in the figure and in the table below, return loss values for the connector of FIG. 12A are in the range of about −50 to −25 dB.

Figure 13A:
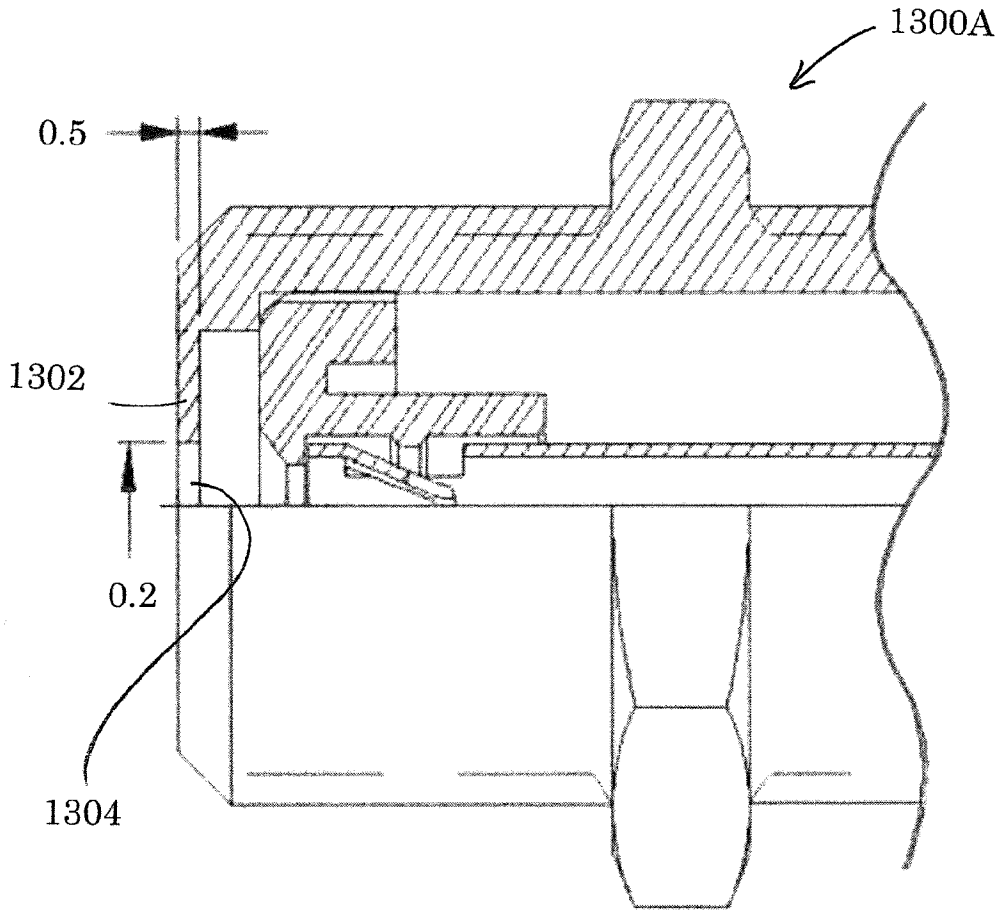
FIGS. 13A-C show a third coaxial cable connector and related performance charts.

FIG. 13A shows a portion of a coaxial cable connector with a waveguide 1300A. The waveguide 1302 is 0.5 mm thick and has a central aperture 1304 that is 2.0 mm in diameter. Notably, other than circular apertures may be used in various embodiments. For example, a triangular or other aperture shape with a similar cross-sectional area might be used here in lieu of the circular aperture.

Figure 13B:
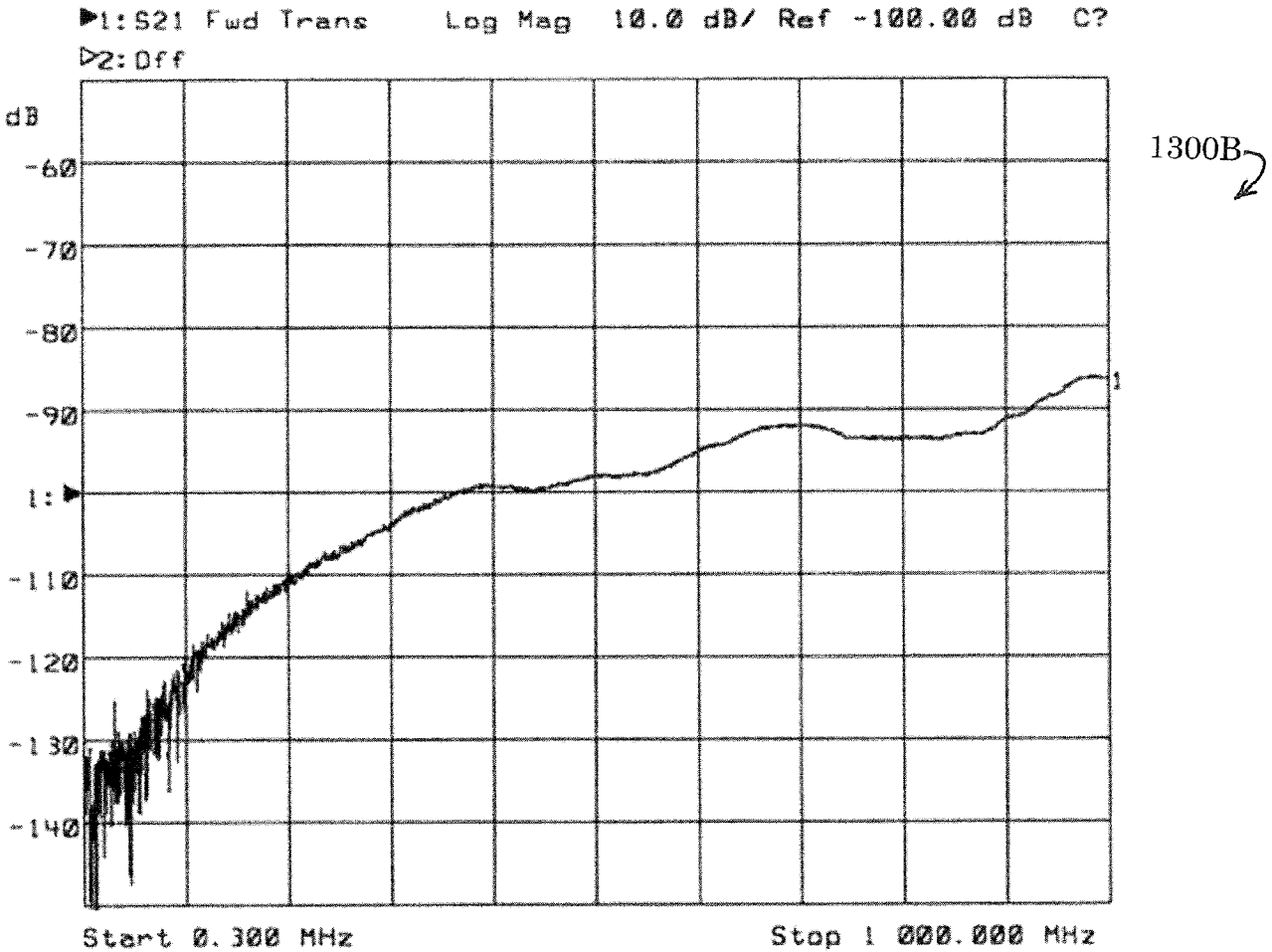

FIG. 13B shows attenuation performance 1300B of the protected connector of FIG. 13A.

| Performance with 2.0 mm Aperture, Connector of FIG. 13A | | |
|---|---|---|
| | 0.300 MHz | 1000 MHz |
| Port Open | −140 dB | −86 dB |
| Improvement Over Connector of FIG. 11A | (−140 − (−120)) = −20 dB | (−86 − (−63)) = −23 dB |

As seen, in the 0.300 MHz to 1000 MHz frequency spectrum, improved attenuation of unwanted ingressing signals is in the range of about −20 to −23 dB.

A lip diameter d2 (d2>d1) describes an annulus 664 between d1 and d2 having a thickness t1 measured along a central axis x-x of the connector.

Figure 13C:
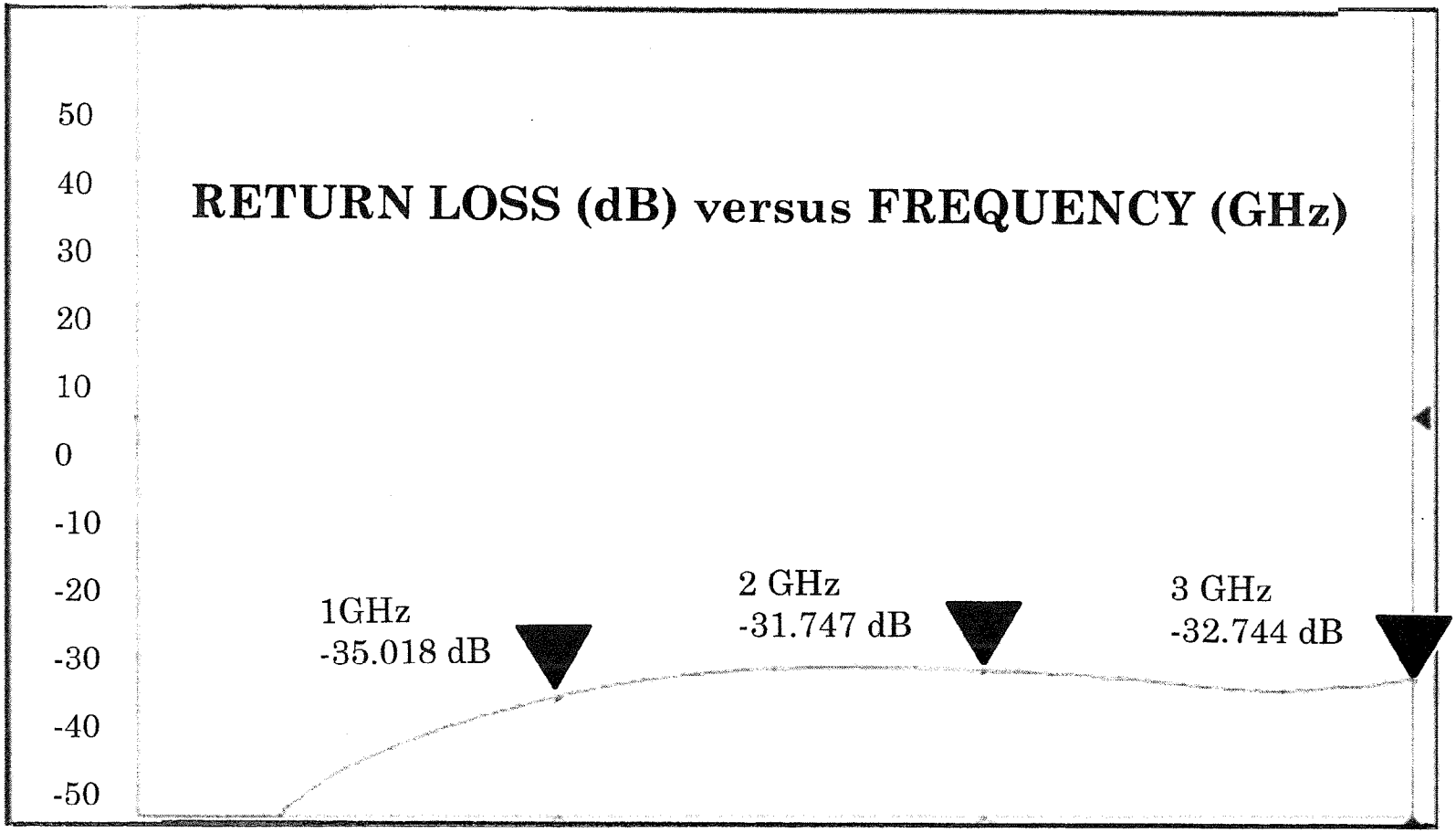

FIG. 13C shows return loss performance 1300C of the protected connector of FIG. 13A. Larger negative dB values of return loss are desirable as they indicate improved impedance matching and reduced signal reflection losses. Typical return loss values maintained in the CATV industry are in the range of about −50 to −10 dB. As seen in the figure and in the table below, return loss values for the connector of FIG. 13A are in the range of about −50 to −32 dB.

Turning now to some alternative waveguide configurations, FIGS. 14A-C, 15, and 16A,B show waveguides installed in bulkhead connectors and connectors such as ports and splices.

Figures 14A, 14B, 14C:
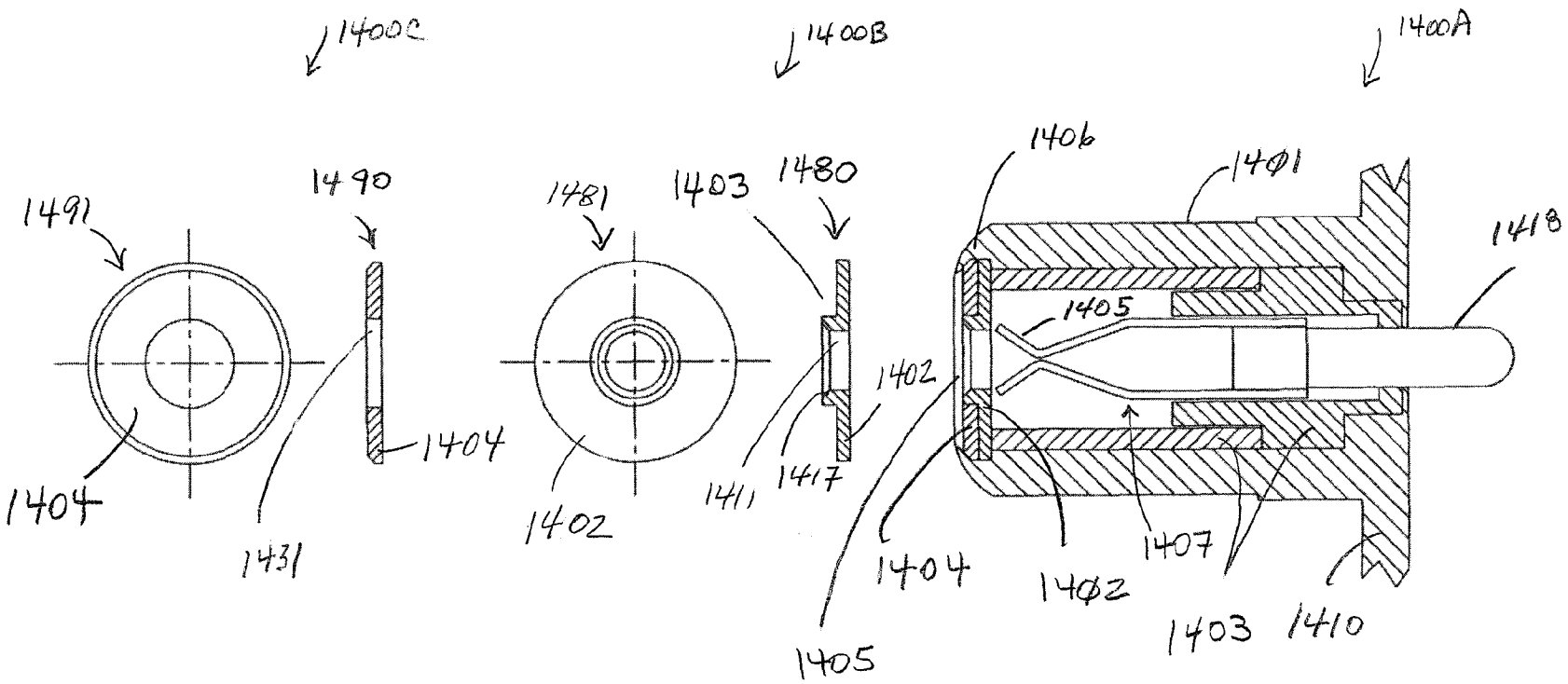
FIGS. 14A-C shows a fourth coaxial connector including a waveguide.

FIG. 14A shows a connector such as a bulkhead mountable or bulkhead integral connector 1400A. A connector body 1401 is supported by a connector base 1410 and an insulating structure(s) 1403 within the connector body support a central electrical contact 1407 having a coaxial cable center conductor contactor 1405 and an opposed contacting pin 1418 near the base.

Access to the center conductor contactor 1405 is via an adjacent body end opening 1405. An annular waveguide 1402 located in this opening is adjacent to the center conductor contactor. In some embodiments, an outer ring 1404 abuts the waveguide. In various embodiments, the waveguide is held in place by a deformed or staked end of the body 1406 that overlaps the waveguide or outer ring.

FIG. 14B shows the waveguide 1400B. Profile 1480 and end 1481 views show the annular structure of the waveguide. As seen in the profile view, an embodiment of the waveguide includes a generally cylindrical waveguide lip 1403. The lip encircles and projects from the waveguide aperture 1411 to define a coaxial cable center conductor mouth. Some embodiments include a lip internal entry taper 1417 that guides a coaxial cable central conductor into the waveguide aperture 1411.

FIG. 14 C shows the optional outer ring embodiment 1400C. Profile 1490 and end 1491 views show the annular structure of the outer ring 1404. As seen in the profile view, the ring forms a lip receiving hole 1431 for receiving the waveguide lip 1403 as shown in FIG. 14A.

In a connector embodiment 1400A including the outer ring 1404, one closure method incorporates a metal or RF conductive waveguide 1402 used in an F female port with a deformable waveguide fixing end such that horizontal port cast metal bodies may be equipped with the waveguide.

Figure 15:
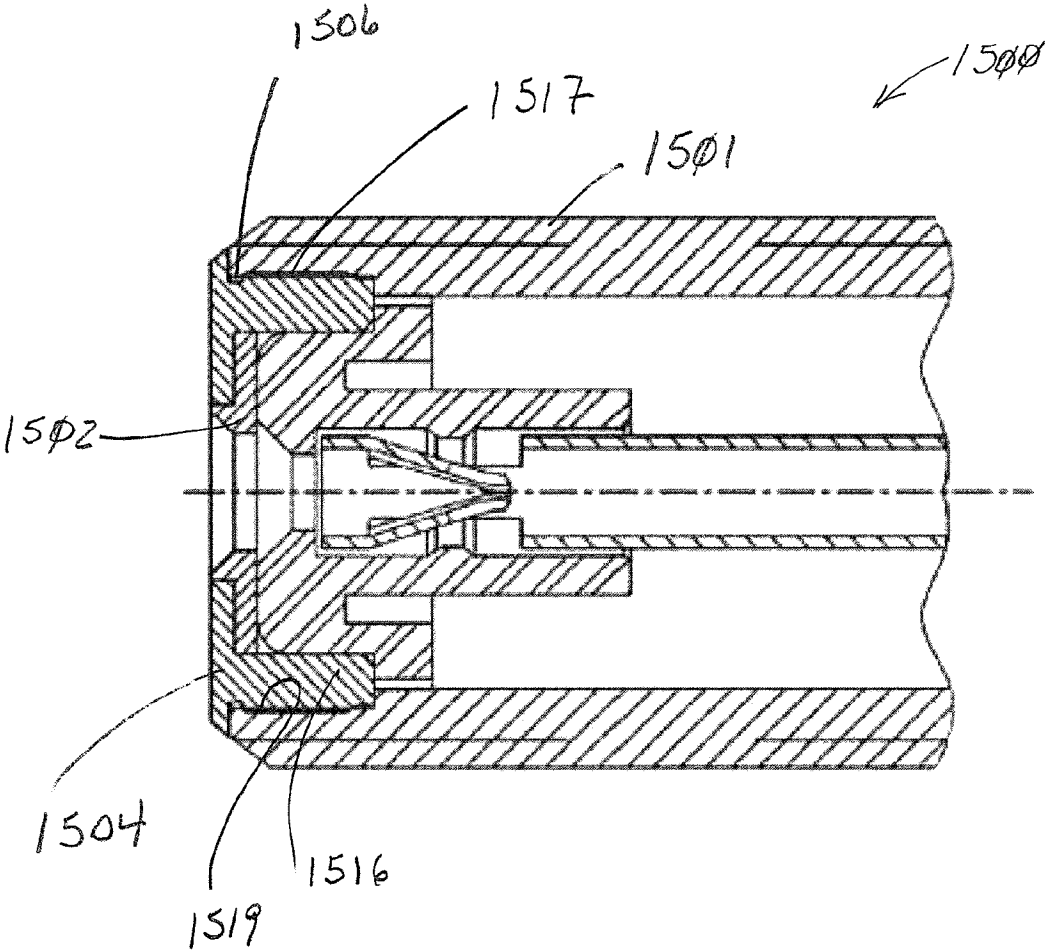
FIG. 15 shows a fifth coaxial connector including a waveguide.

FIG. 15 shows a connector female port 1500. As discussed in connection with FIGS. 14A-C above, the port of FIG. 15 utilizes a waveguide 1502 and an outer ring 1504 such as an interengaging waveguide and ring. These parts are fitted into a connector body 1501 opening 1506 and an extended cylindrical shank 1516 of the outer ring provides a fixation means, for example an interference fit 1517 with a bore 1519 of the body.

Figure 16B:
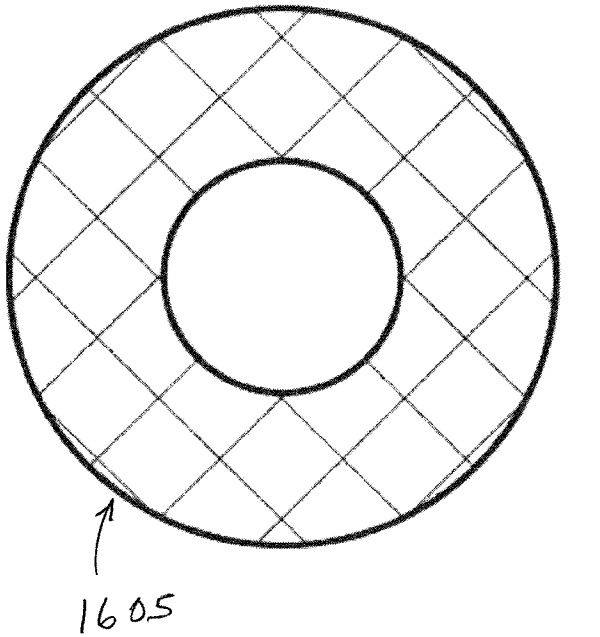
FIGS. 16A-B show a coaxial cable connector insulator with a waveguide.
Figure 16A:
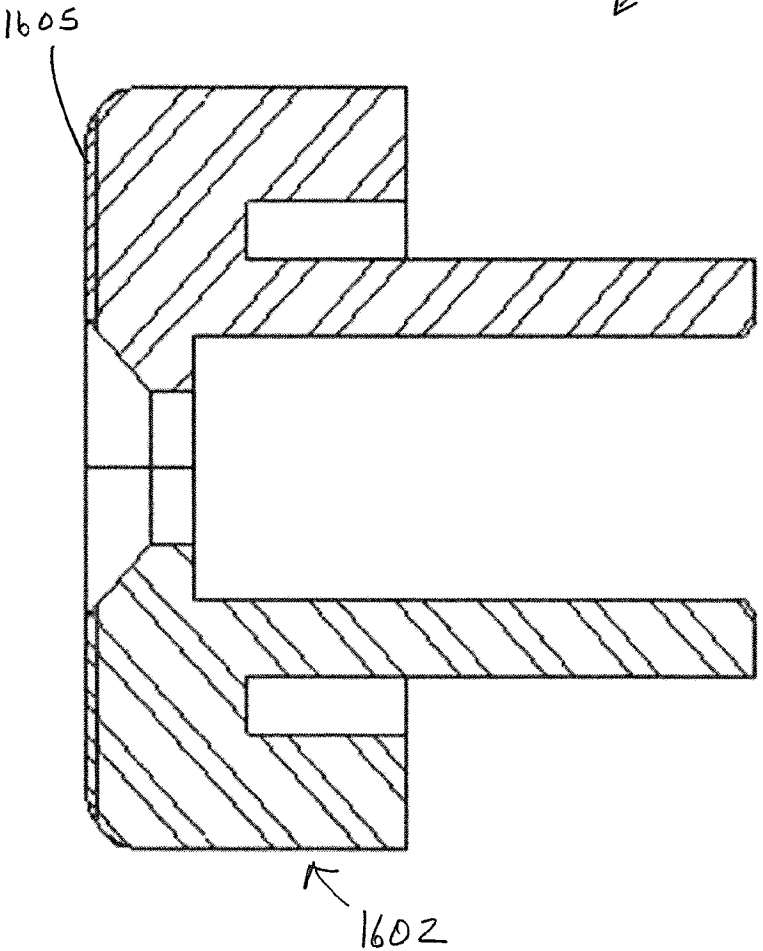

FIGS. 16A,B show a coaxial connector port insulator and waveguide 1600A,B. In particular, FIG. 16A shows a connector port insulator 1602 together with a waveguide 1605. FIG. 16 B shows the waveguide 1605. In some embodiments, the waveguide is a separable disc. And, in some embodiments, the waveguide is integral with the insulator and includes one or more of RF shielding material that is a coating, an impregnate, a commix with insulator plastic, an insert, and the like. In an embodiment, the waveguide is a metallic plating on the cable entry side of the insulator. In an embodiment, the waveguide is a metallic plating on the surface of the cable entry side of the insulator.

While various embodiments of the present invention have been described above, it should be understood that they have been presented by way of example only, and not limitation. It will be apparent to those skilled in the art that various changes in the form and details can be made without departing from the spirit and scope of the invention. As such, the breadth and scope of the present invention should not be limited by the above-described exemplary embodiments, but should be defined only in accordance with the following claims and equivalents thereof.

What is claimed is:

1. A coaxial cable connector comprising:
an outer connector body;
a female end of the connector is for engaging a male coaxial cable connector;
the connector female end having a waveguide with an aperture for receiving a center conductor of a coaxial cable;
the waveguide made from a non-metallic base bearing an RF shielding material;
wherein a diameter of the aperture is in a range 1.5 mm to 3.0 mm; and,
wherein the waveguide is configured to shield connector body internals from ingress of radio frequency signals in a range of 1 to 1000 megahertz.

2. The connector of claim 1 further comprising:
a waveguide surface;
the waveguide surface bordering the aperture and an aperture centerline about perpendicular to the waveguide surface;
a thickness of a waveguide surface measured along a line parallel to the aperture centerline is not less than 0.5 mm; and,
the thickness of the waveguide surface measured along a line parallel to the aperture centerline is not more than 2.0 mm.

3. The connector of claim 2 wherein the diameter of the aperture and the thickness of the waveguide are configured to provide a nominal 75 ohm connection.

4. The connector of claim 3 further comprising:
a rim of the outer connector body; and,
the waveguide formed at least in part by the rim.

5. The connector of claim 3 further comprising:
a rim of the outer connector body; and,
the waveguide formed by a disc separable from the connector body.

6. A coaxial cable connector comprising:
an outer connector body;
a female end of the connector is for engaging a male coaxial cable connector;
the connector female end having a waveguide with an aperture for receiving a
center conductor of a coaxial cable;
wherein the waveguide is made from (i) a metallically impregnated polymer or ceramic material or (ii) a polymer, ceramic, or fiberglass type material with a sputtered or etched magnetic material on a waveguide surface;
a diameter of the aperture is not less than two times the diameter of the center conductor;
the diameter of the aperture is not more than 4 times the diameter of the center conductor; and,
wherein the waveguide is configured to shield connector body internals from ingress of radio frequency signals in a range of 1 to 1000 megahertz while maintaining a nominal connector impedance of 75 ohms.

7. The connector of claim 6 further comprising:
a waveguide surface;
the waveguide surface bordering the aperture and an aperture centerline about perpendicular to the waveguide surface;
a thickness of a waveguide surface measured along a line parallel to the aperture centerline is not less than 0.5 mm; and,
the thickness of the waveguide surface measured along a line parallel to the aperture centerline is not more than 2.0 mm.

8. The connector of claim 6 wherein the diameter of the aperture and a thickness of the waveguide are selected to achieve a connector nominal impedance of 75 ohms.

9. The connector of claim 8 further comprising:
a rim of the outer connector body; and,
the waveguide formed by the rim.

10. The connector of claim 8 further comprising:
a fixture of the outer connector body; and,
the waveguide formed by a disc held in place by the fixture.

11. The connector of claim 10 wherein the fixture is a rim integral with the connector body.

12. A female F connector comprising:
a center conductor entry hole having an area;
the area equivalent to that of a circle having a diameter in a range of 1.5 to 3.0 mm;
the entry hole defined by at least one of a connector body and a waveguide disc;
the entry hole bounded by a wall having a thickness in a range of 0.5 to 2.0 mm;
a blind connector body and a waveguide disc fixation formed by a body end-rim;
the entry hole is defined by the waveguide disc;
the waveguide disc fixation configured to keep an outer ring within the connector body;
the outer ring configured to keep the waveguide disc within the connector body; and,
the outer ring encircles a waveguide disc lip that encircles the entry hole.

13. A female F connector comprising:
an end opening body hole and a separate entry disk behind the hole with a 1.5 to 3 mm port and a thickness of 0.5 to 1.5 mm; and,
wherein the disk includes plural slotted openings.

14. A nominal 75 ohm female F connector comprising:
a center conductor entry hole having an area;
the area equivalent to that of a circle having a diameter in a range of 1.5 to 3.0 mm;
the entry hole bounded by a wall having a thickness in a range of 0.5 to 2.0 mm;
the entry hole defined by a waveguide disc;

a blind connector body and a waveguide disc fixation at a body end;

the waveguide and an adjacent ring overlap in pin and socket type coaxial arrangement; and, the waveguide disc fixation configured to keep the waveguide disc and the ring within the connector body.

* * * * *